US009447660B2

(12) United States Patent
Anderson et al.

(10) Patent No.: US 9,447,660 B2
(45) Date of Patent: Sep. 20, 2016

(54) SUBSEA WELL CONTAINMENT SYSTEMS AND METHODS

(71) Applicants: Paul Edward Anderson, Peyton, CO (US); Troy A. Fraske, Houston, TX (US); Daniel Gutierrez, Houston, TX (US); Fred L. Smith, Carson City, NV (US); Luis J. Gutierrez, Houston, TX (US)

(72) Inventors: Paul Edward Anderson, Peyton, CO (US); Troy A. Fraske, Houston, TX (US); Daniel Gutierrez, Houston, TX (US); Fred L. Smith, Carson City, NV (US); Luis J. Gutierrez, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 0 days.

(21) Appl. No.: 13/839,789

(22) Filed: Mar. 15, 2013

(65) Prior Publication Data

US 2014/0090853 A1 Apr. 3, 2014

Related U.S. Application Data

(60) Provisional application No. 61/707,193, filed on Sep. 28, 2012.

(51) Int. Cl.

| | |
|---|---|
| ***E21B 43/01*** | (2006.01) |
| ***E21B 41/00*** | (2006.01) |
| ***E21B 33/14*** | (2006.01) |
| ***E21B 21/015*** | (2006.01) |
| ***E21B 21/08*** | (2006.01) |

(52) U.S. Cl.

CPC ..... *E21B 41/0007* (2013.01); *E21B 21/015* (2013.01); *E21B 21/08* (2013.01); *E21B 33/143* (2013.01)

(58) Field of Classification Search

CPC ..... E21B 33/14; E21B 43/01233
USPC ..... 166/351, 360
See application file for complete search history.

(56) References Cited

U.S. PATENT DOCUMENTS

| | | | | |
|---|---|---|---|---|
| 4,568,220 | A * | 2/1986 | Hickey | 405/60 |
| 5,050,680 | A * | 9/1991 | Diehl | E21B 33/037 137/312 |
| 5,150,751 | A * | 9/1992 | Burton et al. | 166/81.1 |
| 5,899,637 | A * | 5/1999 | Blanchard et al. | 405/210 |
| 7,325,598 | B2 * | 2/2008 | Bartlett | 166/75.13 |
| 2009/0206111 | A1 * | 8/2009 | Conrardy et al. | 222/386.5 |
| 2011/0307105 | A1 * | 12/2011 | Commoner | E21B 43/0122 700/282 |

FOREIGN PATENT DOCUMENTS

| | | |
|---|---|---|
| GB | 2 066 095 | 10/1980 |
| GB | 2 242 220 | 3/1990 |
| GB | 2 448 200 | 8/2007 |

* cited by examiner

*Primary Examiner* — Matthew R Buck
*Assistant Examiner* — Patrick Lambe
(74) *Attorney, Agent, or Firm* — Jayne C. Piana

(57) ABSTRACT

A subsea containment system for capturing fluids leaking from a subsea well includes a clamping assembly and a storage system. The clamp assembly includes an annular clamp body configured to be disposed about the upper end of the well and a fluid outlet extending from the clamp body. The fluid outlet is in fluid communication with an inner cavity of the clamp body. The storage system is coupled to the fluid outlet of the clamping assembly. The storage system includes a first storage tank having an inlet in fluid communication with the inner cavity of the clamp body and a plurality of vertically spaced outlets.

15 Claims, 31 Drawing Sheets

SUBSEA WELL CONTAINMENT SYSTEMS AND METHODS

CROSS-REFERENCE TO RELATED APPLICATIONS

This application claims benefit of U.S. provisional patent application Ser. No. 61/707,193 file Sep. 28, 2012, and entitled "Subsea Well Containment Systems And Methods." which is hereby incorporated herein by reference in its entirety for all purposes.

STATEMENT REGARDING FEDERALLY SPONSORED RESEARCH OR DEVELOPMENT

Not applicable.

BACKGROUND

The invention relates generally to systems and methods for containing fluids expelled from a subsea wellhead. More particularly, the invention relates to remedial systems and methods for containing fluids discharged from the cement ports of a subsea wellhead.

In offshore drilling operations, a large diameter hole is drilled to a selected depth in the sea bed. Then, a primary conductor secured to the lower end of an outer wellhead housing, also referred to as a low pressure housing, is run into the borehole with the outer wellhead housing positioned at the sea floor. A wellhead guide base used to facilitate subsequent installation of equipment is typically mounted to and run with the outer wellhead housing. Cement is pumped down the primary conductor and allowed to flow back up the annulus between the primary conductor and the borehole sidewall.

With the primary conductor secured in place, a drill bit is lowered through the primary conductor to drill the borehole to a second depth. Next, an inner wellhead housing, also referred to as a high pressure housing, is seated in the upper end of the outer wellhead housing. A string of casing secured to the lower end of the inner wellhead housing or seated in the inner wellhead housing extends downward through the primary conductor. Cement is pumped down the casing string, and allowed to flow back up the annulus between the casing string and the primary conductor and out cement ports extending radially through the outer wellhead housing. The cement ports can be opened to allow flow therethrough, or closed to prevent flow therethrough, by a cement port closure sleeve moveably disposed over the cement ports. Drilling continues while successively installing concentric casing strings that line the borehole. Each casing string is cemented in place by pumping cement down the casing and allowing it to flow back up the annulus between the casing string and the borehole sidewall.

Following drilling operations, the cased well is converted for production by running production tubing through the casing, which is typically suspended by a tubing hanger seated in a mating profile in the inner wellhead housing. A production tree having a production bore and associated valves is lowered subsea and mounted to the inner wellhead housing.

The failure of seals between the inner wellhead housing or casing and the outer wellhead housing or primary conductor, and/or failure of the cement port closure sleeve may result in leakage of fluid trapped in the annulus between the inner wellhead housing or casing and the outer wellhead housing or primary conductor. Such fluids may include drilling mud trapped in the annulus during drilling of the well. In instances where oil based muds were used to drill the borehole, leakage of drilling mud from the annulus into the surrounding sea water is particularly problematic from an environmental regulations perspective. For example, FIGS. 1 and 2 illustrate a subsea well 10 extending downward from the sea floor 11. Well 10 includes an outer wellhead housing 20 proximal the sea floor 11, a primary conductor 21 extending downward from outer wellhead housing 20, a wellhead guide base 22 mounted to outer wellhead housing 20, an inner wellhead housing 23 seated in outer wellhead housing 20, a casing string 24 extending downward from inner wellhead housing 23, and a production tree 25 coupled to inner wellhead housing 23. An annulus 26 is formed between casing string 24 and primary conductor 21. Outer wellhead housing 23 includes cement ports 27 extending radially therethrough and a cement port closure sleeve 28 for closing off ports 27. Normally, annulus 26 is filled with cement. However, in some cases, drilling fluids may get trapped within the upper portion of annulus 26 proximal ports 27. If sleeve 28 is unable to fully close ports 27 (e.g., due to failure of a seal, etc.), such drilling fluids may undesirable leak from well 10 into the surrounding sea water.

BRIEF SUMMARY OF THE DISCLOSURE

These and other needs in the art are addressed in one embodiment by a subsea containment system for capturing fluids leaking from a subsea well having an upper end including a primary conductor extending into the sea bed, an outer wellhead housing coupled to the primary conductor, and an inner wellhead housing mounted to the outer wellhead housing. In an embodiment, the containment system comprises a clamping assembly including an annular clamp body configured to be disposed about the upper end of the well and a fluid outlet extending from the clamp body. The fluid outlet is in fluid communication with an inner cavity of the clamp body. In addition, the containment system comprises a storage system coupled to the fluid outlet of the clamping assembly. The storage system includes a first storage tank having an inlet in fluid communication with the inner cavity of the clamp body and a plurality of vertically spaced outlets.

These and other needs in the art are addressed in another embodiment by a method for capturing and containing fluids leaking from a subsea well having an upper end including a primary conductor extending into the sea bed, an outer wellhead housing coupled to the primary conductor, and an inner wellhead housing mounted to the outer wellhead housing. In an embodiment, the method comprises (a) mounting an annular clamp body around the upper end of the well. In addition, the method comprises (b) lowering a storage system subsea. Further, the method comprises (c) connecting the storage system to the body. Still further, the method comprises (d) diverting fluids leaking from the upper end of the well from the clamping assembly to the storage assembly.

These and other needs in the art are addressed in another embodiment by a method for capturing and containing fluids leaking from a subsea well. In an embodiment, the method comprises (a) lowering a storage system subsea. The storage system includes a first storage tank and a second storage tank. Each storage tank includes an inlet and a plurality of vertically spaced outlets. In addition, the method comprises (b) connecting the first storage tank to the second storage tank. Further, the method comprises (c) flowing leaked fluids into the first storage tank through the inlet of the first storage tank. Still further, the method comprises (d) displacing sea water in the first storage tank with the leaked fluids during (c).

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
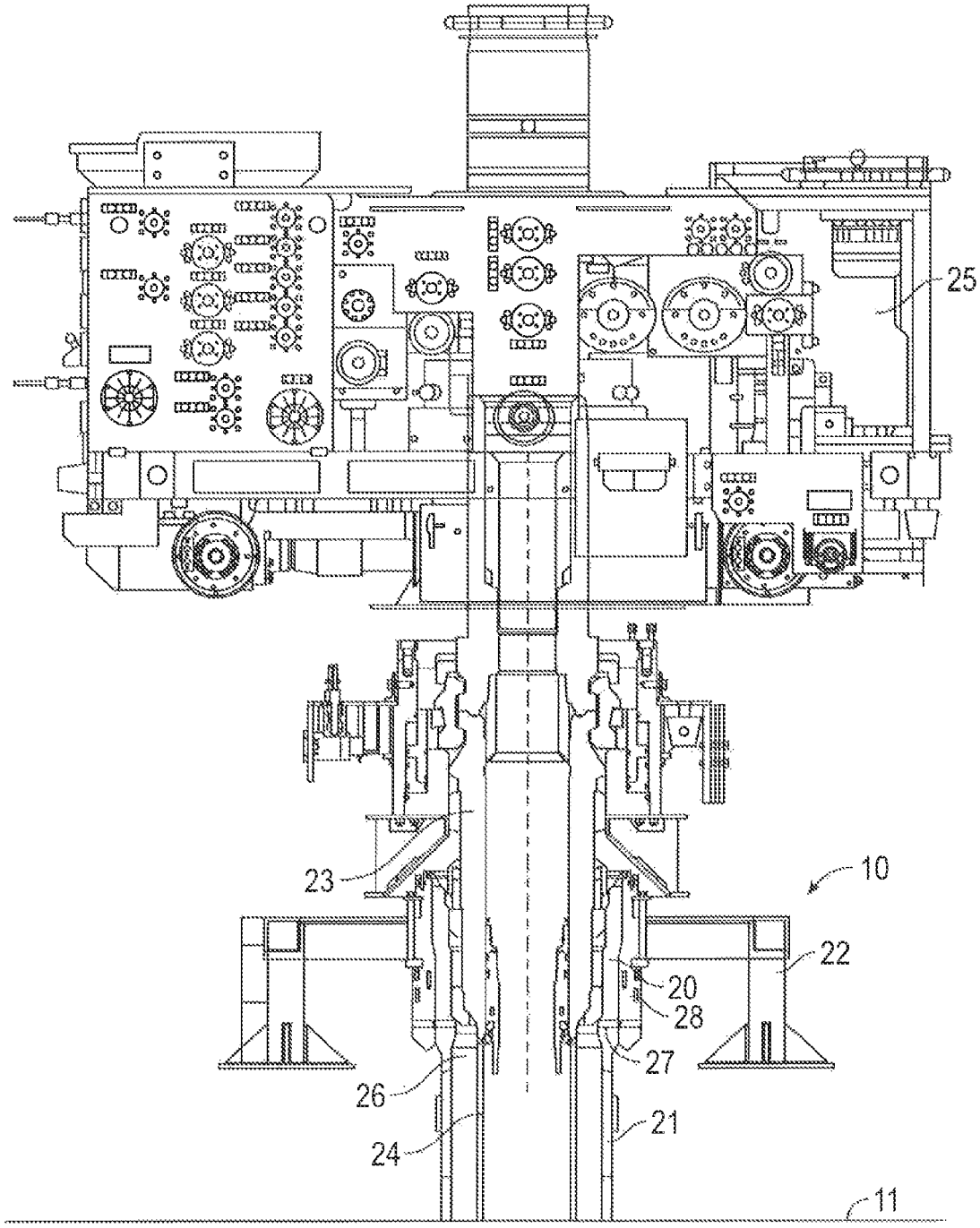
FIG. 1 is a partial cross-sectional view of a subsea well.
Figure 2:
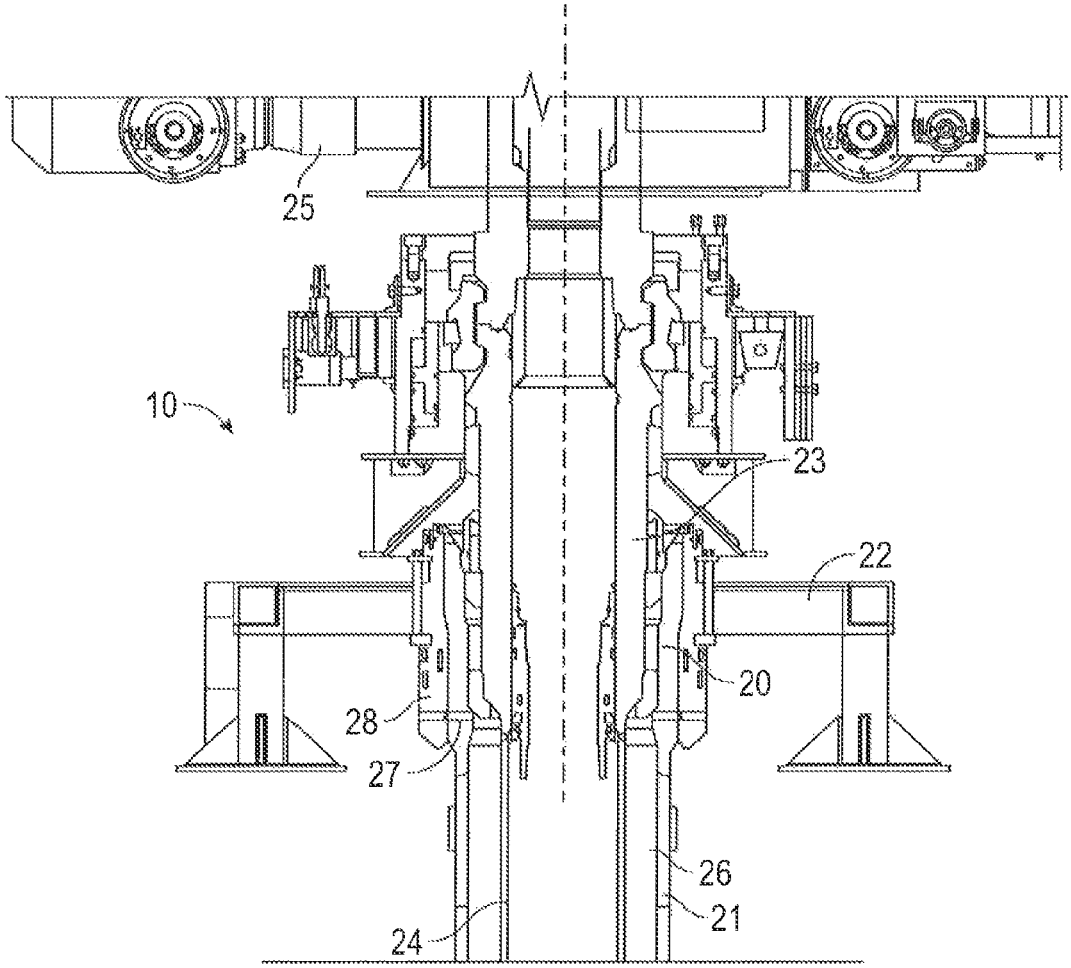
FIG. 2 is an enlarged view of the outer wellhead housing, the inner wellhead housing, the cement ports, and the cement port closure sleeve of FIG. 1.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Figure 3:
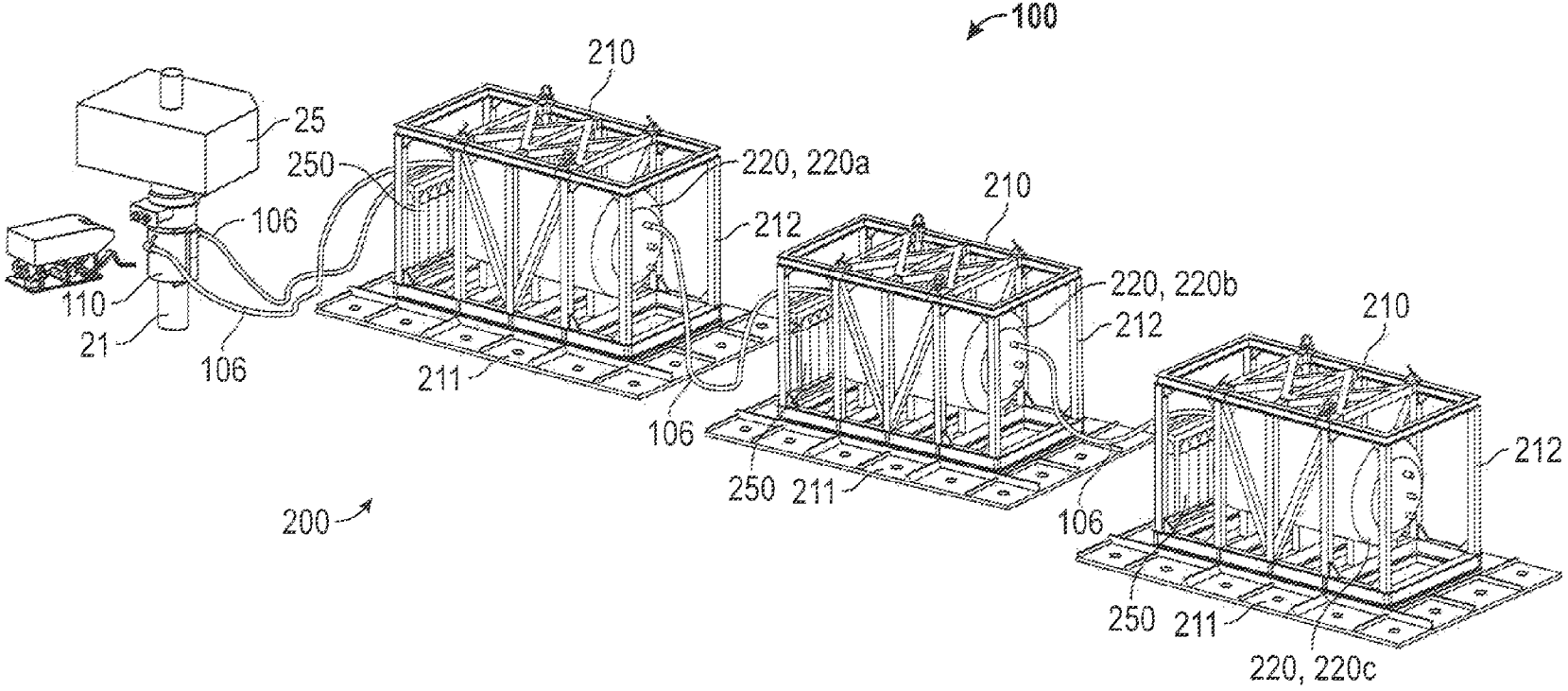
FIG. 3 is a perspective view of a subsea containment system for capturing fluids leaking from the cement ports of the subsea well of FIG. 1.
Figure 4:
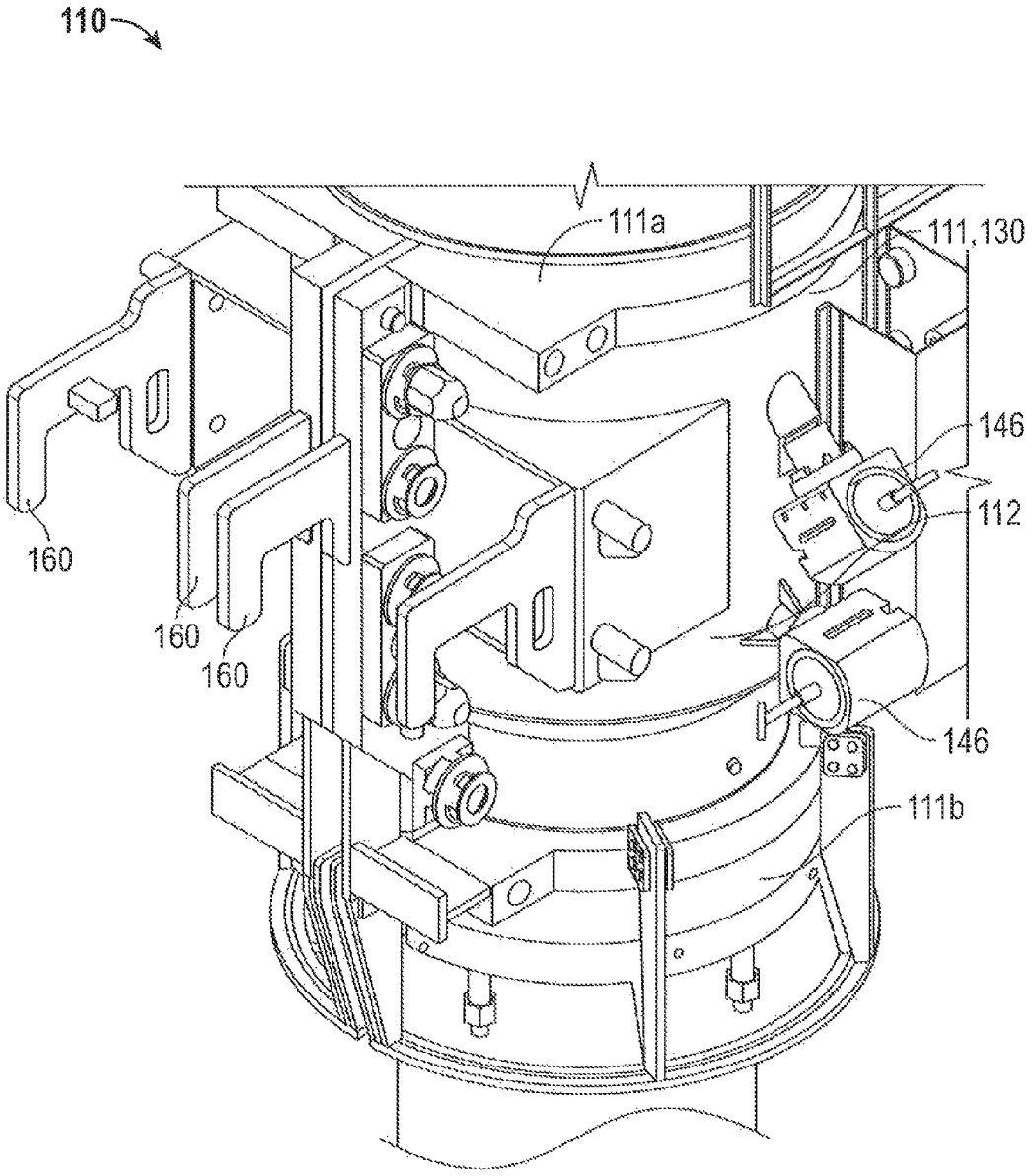
FIG. 4 is an enlarged view of the clamping assembly of FIG. 3 mounted to the inner wellhead housing and primary conductor of FIG. 3.

Referring now to FIG. 3, an embodiment of a subsea containment system 100 for capturing and containing fluids leaking from cement ports 27 of well 10 previously described is shown. Containment system 100 is deployed subsea and includes a wellhead clamp assembly 110 encapsulating cement ports 27 and isolation sleeve 28 to ensure all leak paths are contained, and a subsea fluid storage system 200 disposed on the sea floor 11. As shown in FIGS. 3 and 4, clamp assembly 110 is disposed about outer wellhead housing 20, inner wellhead housing 23, and primary conductor 21, and sealingly engages inner wellhead housing 23 and primary conductor 21 axially adjacent outer wellhead housing 20. Storage system 200 is in fluid communication with an annulus 105 (FIG. 5) between wellhead housings 20, 23 and clamp assembly 110 via a pair of flexible conduits or jumpers 106. Thus, fluids leaking from ports 27 and isolation sleeve 28 into annulus 105 (FIG. 5) are contained by clamp assembly 110, and diverted to storage system 200.

Referring now to FIGS. 4-7, clamp assembly 110 includes a rigid generally cylindrical body 111, a pair of ROV panels 150 coupled to body 111, and a deployment or support bracket 160 coupled to body 111. Body 111 has a central or longitudinal axis 115, a first or upper end 111*a*, a second or lower end 111*b*, a radially outer annular wall 112 extending axially between ends 111*a*, 111*b*, an annular flange 113 extending radially inward from wall 112 at upper end 111*a*, and an annular flange 114 extending radially inward from wall 112 at lower end 111*b*. Outer wall 112 and flanges 113, 114 define an internal chamber or cavity 116 within body 111. A through passage 117 extending axially through upper flange 113 to cavity 116, and a through passage 118 extends axially through lower flange 114 to cavity 116. Passages 117, 118 are coaxially aligned with axis 115 and are sized to receive inner wellhead housing 23 and primary conductor 21, respectively, when clamp assembly 110 is mounted thereto. In particular, each passage 117, 118 has a radius that is substantially the same or slightly greater than the outer radius of housing 23 and primary conductor 21, respectively. An upper annular seal assembly 120 is disposed along the radially inner surface of upper flange 113 facing passage 117, and a lower seal assembly 125 is disposed along the radially inner surface of lower flange 114 facing passage 118. Seal assemblies 120, 125 are configured to sealingly engage and form an annular seal with housing 23 and primary conductor 21, respectively.

Figure 5:
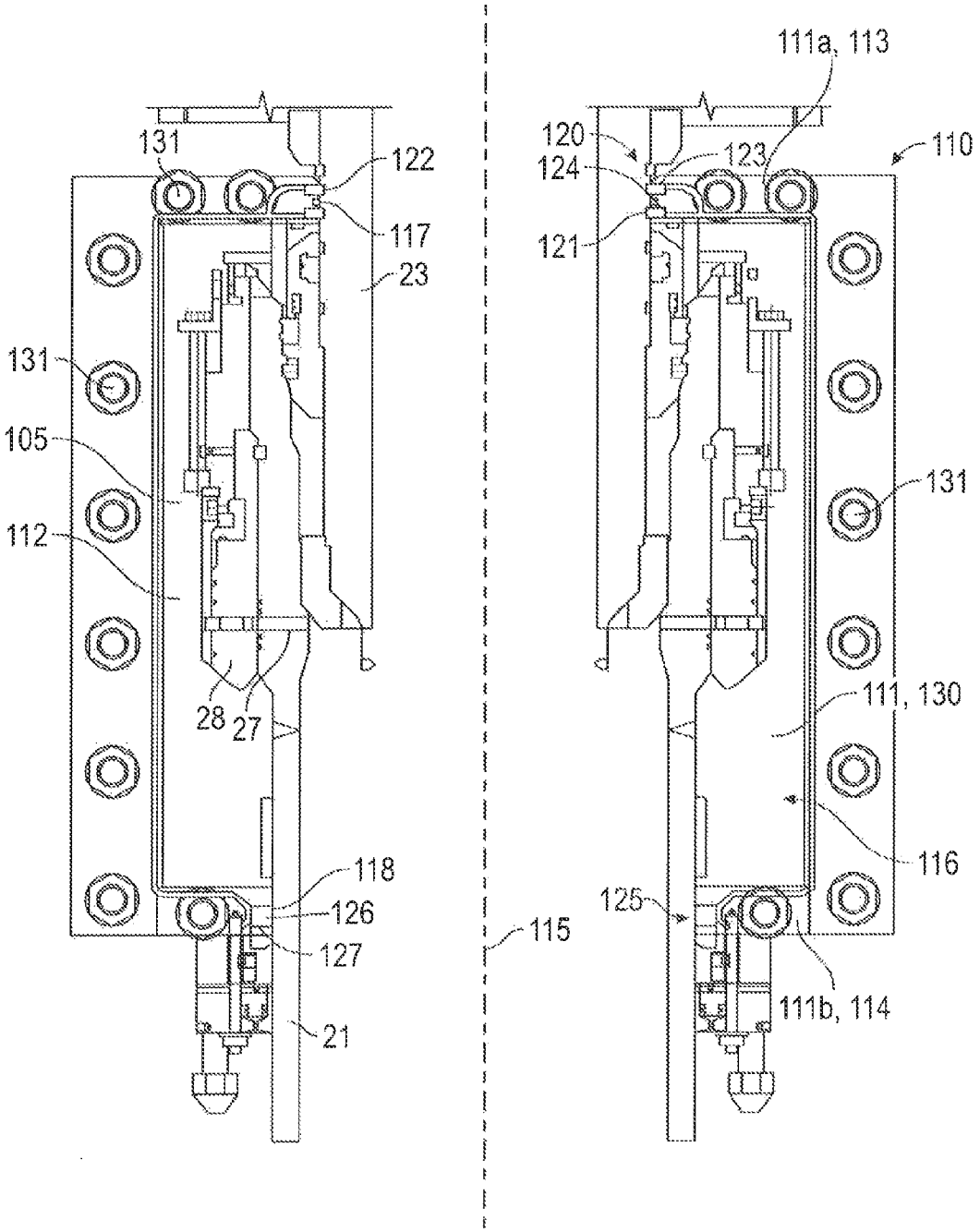
FIG. 5 is a partial cross-sectional view of the clamping assembly of FIG. 3 mounted to the inner wellhead housing and primary conductor of FIG. 3.

As best shown in FIG. 5, in this embodiment, upper seal assembly 120 includes a pair of axially spaced annular seal elements 121, 122 seated in mating annular glands or recesses 123, 124, respectively, formed in flange 113. Seal elements 121, 122 are compression-type seals that are energized as they are compressed between clamp assembly 110 and inner wellhead housing 23. As will be described in more detail below, seal elements 121, 122 can also be hydraulically energized. Typically, the outer geometry of inner wellhead housing 23 is well defined and known, and the outer surface of inner wellhead housing 23 is machined. Therefore, passage 117 and upper seal assembly 120 are preferably manufactured with relatively tight tolerances to ensure a good seal with inner wellhead housing 23.

As best shown in FIG. 5, in this embodiment, lower seal assembly 125 includes annular seal element 126 seated in a mating annular recess 127 formed in flange 114. Seal element 126 is a split flange packer-type seal that is energized by hydraulic pressure. Typically, the outer geometry, dimensions, and surface finish of primary conductor 21 are not well defined or known. In particular, the portion of the outer surface of primary conductor 21 engaged by seal element 126 is prone to dimensional irregularities at least in part due to the annular welded seam between outer wellhead housing 20 and primary conductor 21. Therefore, passage 118 and lower seal assembly 125 are manufactured with flexible tolerances to accommodate potential variations in primary conductor 21.

Figure 6:
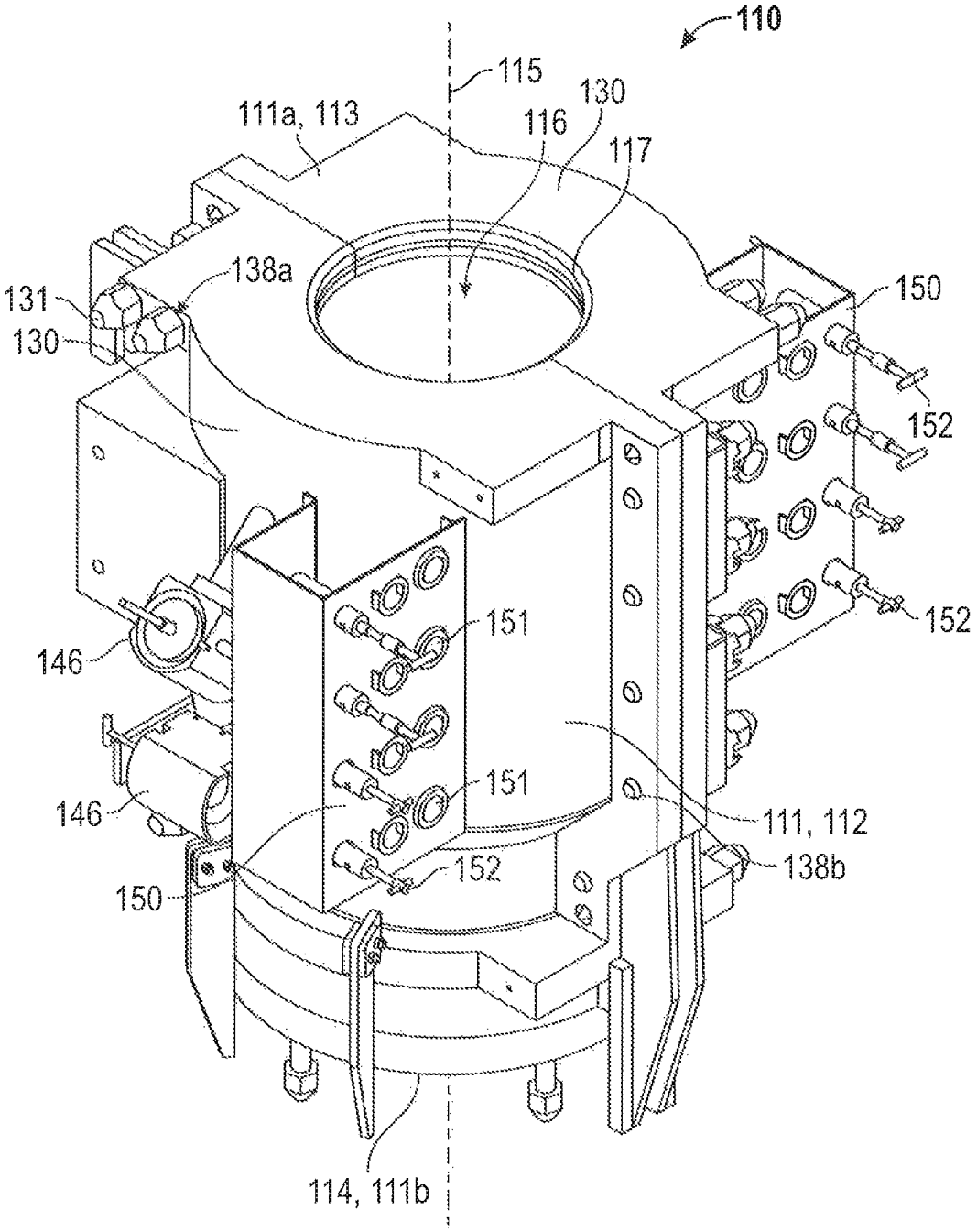
FIG. 6 is a perspective view of the wellhead clamp assembly of the subsea containment system of FIG. 3.
Figure 7:
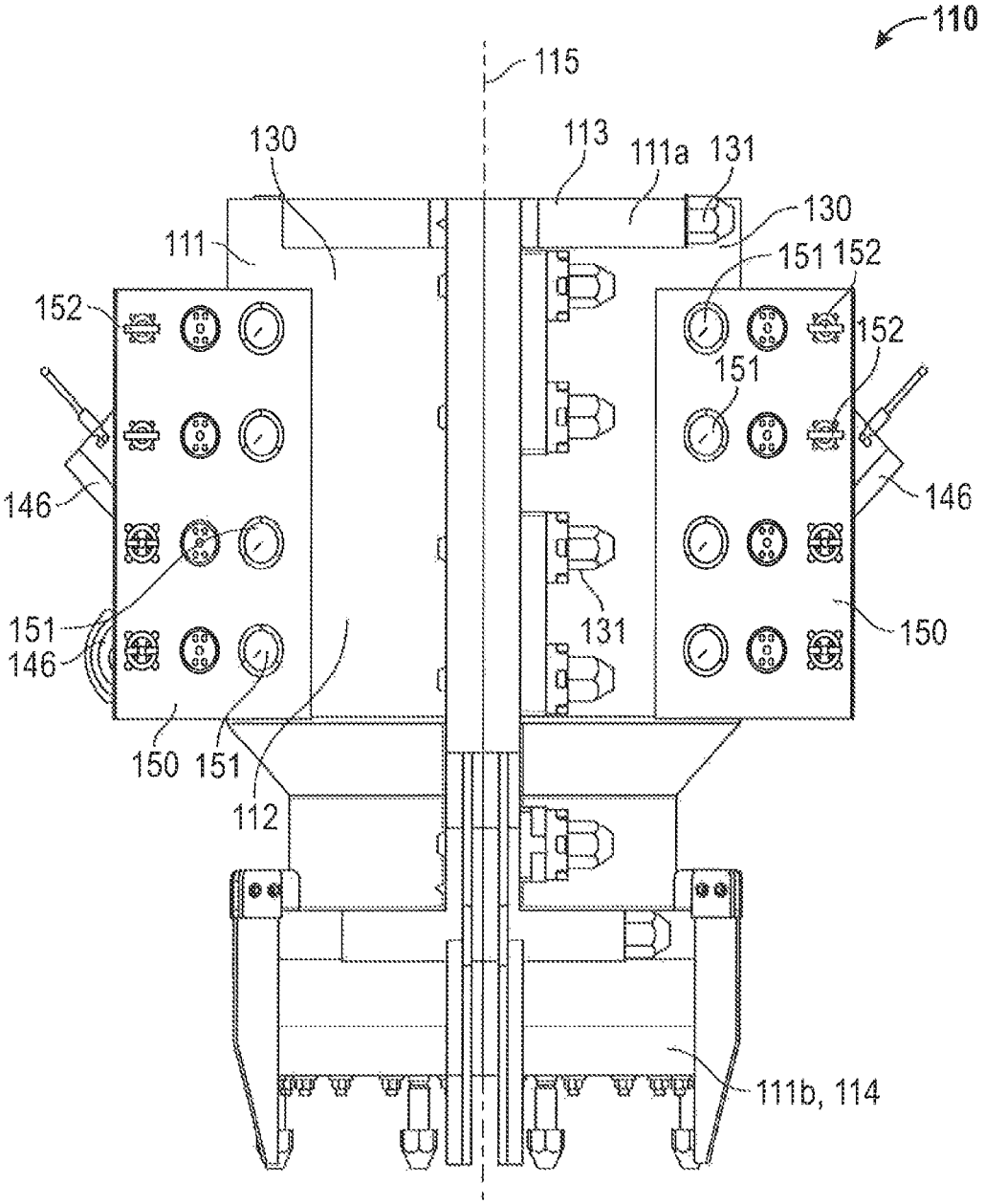
FIG. 7 is a front view of the clamp assembly of FIG. 6.
Figure 8:
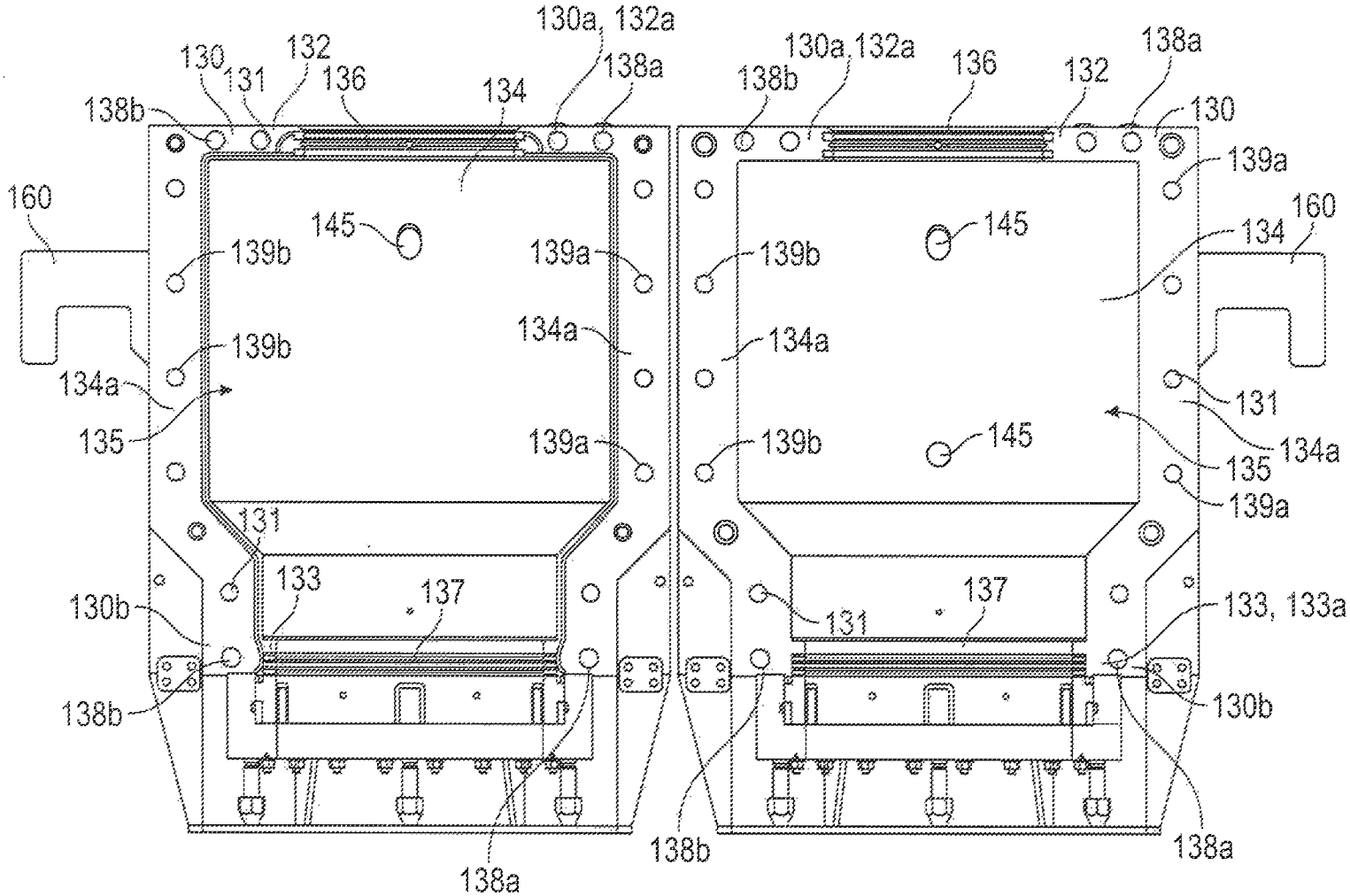
FIG. 8 is a front view of each flanged half body of FIG. 6.

Referring now to FIGS. 6-8, in this embodiment, body 111 is a split body including a pair of clamp portions or half bodies 130 releasably attached together with a plurality of bolts 131. As will be described in more detail below, forming body 111 with two half bodies 130 allows body 111 to be disposed about and mounted to wellhead housing 23 and primary conductor 21 without removal of production tree 25. Each half body 130 is substantially the same. As best shown in FIG. 8, each half body 130 has a first or upper end 130*a* coincident with end 111*a*, a second or lower end 130*b* coincident with end 111*b*, an upper end wall 132 at end 130*a* defining half of flange 113, a lower end wall 133 at end 130*b* defining half of flange 114, and a generally semi-cylindrical sidewall 134 extending axially between end walls 132, 133. End walls 132, 133 and sidewall 134 define a concave recess 135 that forms half of cavity 116. In addition, each end wall 132 includes a semi-cylindrical cutout 136 that defines half of passage 117 and each end wall 133 includes a semi-cylindrical cutout 137 that defines half of passage 118. Seal assemblies 120, 125 are divided equally between half bodies 130—half of seal assembly 120 is disposed along each cutout 136, and half of each seal assembly 125 is disposed along each cutout 137.

End walls 132, 133 include opposed planar surfaces 132*a*, 133*a*, respectively, that engage upon assembly of half bodies 130. Each circumferential end of each sidewall 134 includes a flange 134*a* that extends axially between the corresponding end walls 132, 133. Opposed flanges 134*a* engage upon assembly of half bodies 130. A pair of through bores 138*a* extend through each end wall 132 perpendicular to planar surface 132*a*, a through bore 138*a* extends through each end wall 133 perpendicular to planar surface 133*a*, a pair of internally threaded bores 138*b* extend perpendicularly from each planar surface 132*a*, and an internally threaded bore 138*b* extends perpendicularly from each planar surface 133*a*. Each bore 138*a* in one half body 130 is opposed and coaxially aligned with one threaded bore 138*b* in the other half body 130. Likewise, a plurality of axially spaced through bores 139*a* extends perpendicularly through one flange 134*a* of each half body 130, and a plurality of axially spaced internally threaded bores 139*b* extend perpendicularly through the other flange 134*a* of each half body 130. Each bore 139*a* in one half body 130 is opposed and coaxially aligned with one threaded bore 139*b* in the other half body 130. To assemble half bodies 130 to form body 111, one bolt 131 is passed through each bore 138*a* and threaded into the aligned bore 138*b*, and one bolt 131 is pass through each bore 139*a* and threaded into the aligned bore 139*b*. The bolts 131 are tightened to pull opposed flanges 134*a* together, opposed end walls 132, and opposed end walls 133 together.

Referring now to FIGS. 6-9, clamp assembly 110 also includes a pressure gauge 140 for measuring the fluid pressure within cavity 116 and a plurality of fluid outlets or ports 145 extending radially from cavity 116 to a conduit coupling 146 attached to the outside of body 111. Each coupling 146 is provided with a valve 147 that controls the flow of fluids therethrough. In this embodiment, three ports 145 and conduit couplings 146 are provided—two ports 145 extend through one half body 130 with the associated conduit couplings 146 attached thereto, and one port 145 extends through the other one half body 130 with the associated conduit coupling 146 attached thereto. Conduit couplings 146 are configured to engage and releasably lock with mating couplings provided on the ends of jumpers 106. In this embodiment, conduit couplings 146 are female receptacles, and more specifically, 4.0 in. hot stab receptacles configured to engage and releasably lock with mating hot stabs provided on the ends of jumpers 106. When a coupling 146 is not in use, it can be closed and blanked off with a plug.

Figure 9:
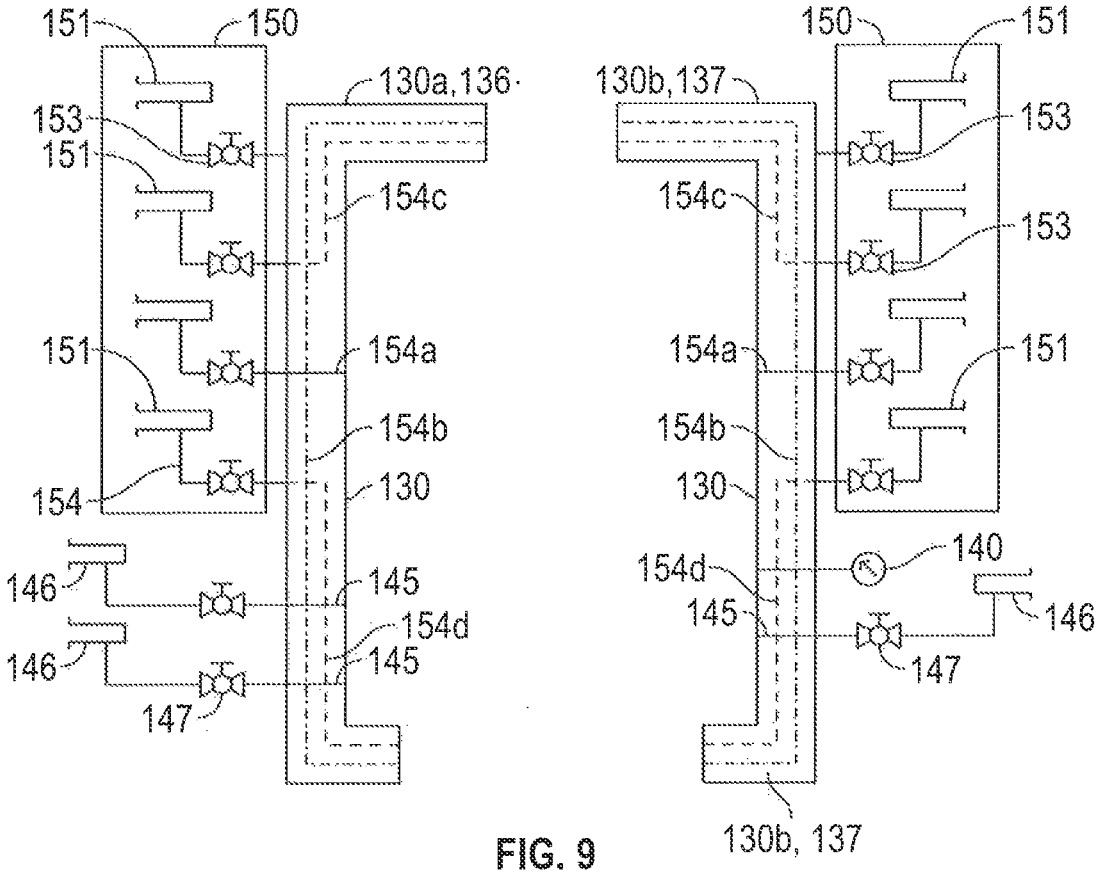
FIG. 9 is a schematic view of the clamp assembly of FIG. 6.

As best shown in FIGS. 6, 7, and 9, one ROV panel 150 is mounted to each body half 130. Each ROV panel 150 includes a plurality of conduit couplings 151 and paddles 152 for actuating valves 153 that control fluid flow through flow lines 154 extending from couplings 151 into body 111. One flow line 154, corresponding valve 153 and paddle 152 is provided for each coupling 151. Paddles 152 enable subsea ROVs to independently actuate valves 153. In this embodiment, each conduit coupling 151 is a receptacle, and in particular, an API 17H hot stab receptacle, configured to engage and releasably lock with a mating API 17H hot stab provided at the end of a fluid conduit (e.g., hose), thereby enabling fluid communication between the fluid conduit and the corresponding flow line 154.

In general, couplings 151, valves 153, and flow lines 154 can be utilized to delivery fluids (e.g., chemicals) to specific locations within body 111. In this embodiment, each ROV panel 150 includes (a) one flow line 154, labeled 154*a*, in fluid communication with cavity 116 for delivering methanol thereto during subsea operations; (b) one flow line 154, labeled 154*b*, in fluid communication with recesses 123, 124, 127 for supplying hydraulic pressure thereto to energize seal elements 121, 122, 126; (c) one flow line 154, labeled 154*c*, in fluid communication with recesses 123, 124 for injecting a sealant therein in the event one or both seal elements 121, 122 fail; and (d) one flow line 154, labeled 154*d*, in fluid communication with recesses 127 for injecting a sealant therein in the event seal elements 126 fails.

Referring again to FIGS. 4 and 8, a pair of support bracket 160 are secured to each half body 130. In this embodiment, each bracket 160 is an inverted U-shaped member that extends radially outward from the corresponding half body 130. As will be described in more detail below, during deployment of half bodies 130, which are coupled together subsea to form body 111 about wellhead housing 23 and primary conductor 21, brackets 160 couple half bodies 130 to the deployment rigging for subsea delivery and installation.

As best shown in FIG. 5, with half bodies 130 disposed about wellhead housings 20, 23 and primary conductor 21, bodies 130 are compressed together with bolts 131 to form body 111, seal elements 121, 122 of upper seal assembly 120 are radially compressed between upper flange 113 and inner wellhead housing 23, and seal element 126 of lower seal assembly 125 is radially compressed between lower flange 114 and primary conductor 21. As a result, an annular seal is formed between upper flange 113 and inner housing 23, and an annular seal is formed between lower flange 114 and primary conductor 21, thereby isolating annulus 105 from the surrounding sea water. The radial compression of seal elements 121, 122, 126 may be sufficient to form the annular seals around wellhead housings 23 and primary conductor 21. However, to further energize seal elements 121, 122, 126 and enhance sealing engagement with wellhead housing 23 and primary conductor 21, pressurized hydraulic fluid can be supplied to seal glands 123, 124, 127 from a subsea ROV via flow lines 154*b* connected to couplings 151 in ROV panels 150. Lock nuts can be used to maintain the compression of seal elements 121, 122, 126 once hydraulic pressure has been bled off. Upon damage and/or failure of seal elements 121, 122, 126, a sealant can be supplied to seal glands 123, 124, 127 from a subsea ROV via flow lines 154*c* connected to couplings 151 in ROV panels 150. As needed, flow lines 154*a* connected to couplings 151 in ROV panels 150 can be used to inject chemicals into annulus 105 such as methanol to inhibit the formation of hydrates within containment system 100.

Referring now to FIGS. 3 and 5, with body 111 securely mounted to wellhead housing 23 and primary conductor 21 above and below cement ports 27 and sleeve 28, and annulus 105 isolated with seal assemblies 120, 125, fluids leaking from ports 27 and/or around sleeve 28 are captured and contained within annulus 105. One jumper 106 is connected to each coupling 146. In particular, one jumper 106 connected to each half body 130 is coupled to storage system 200, and the third jumper 106 (not shown) connected to the remaining coupling 146 is coupled to a subsea pressure relief device such as a pressure relief valve or a burst disc assembly. Thus, with valves 147 open, two jumpers 106 supply fluids from annulus 105 to storage system 200, and the third jumper 106 and associated pressure relief device provide a means of relieving excessive pressure within body 111 to limit and/or prevent damage to clamp assembly 110 and/or downstream storage system 200.

Figure 10A:
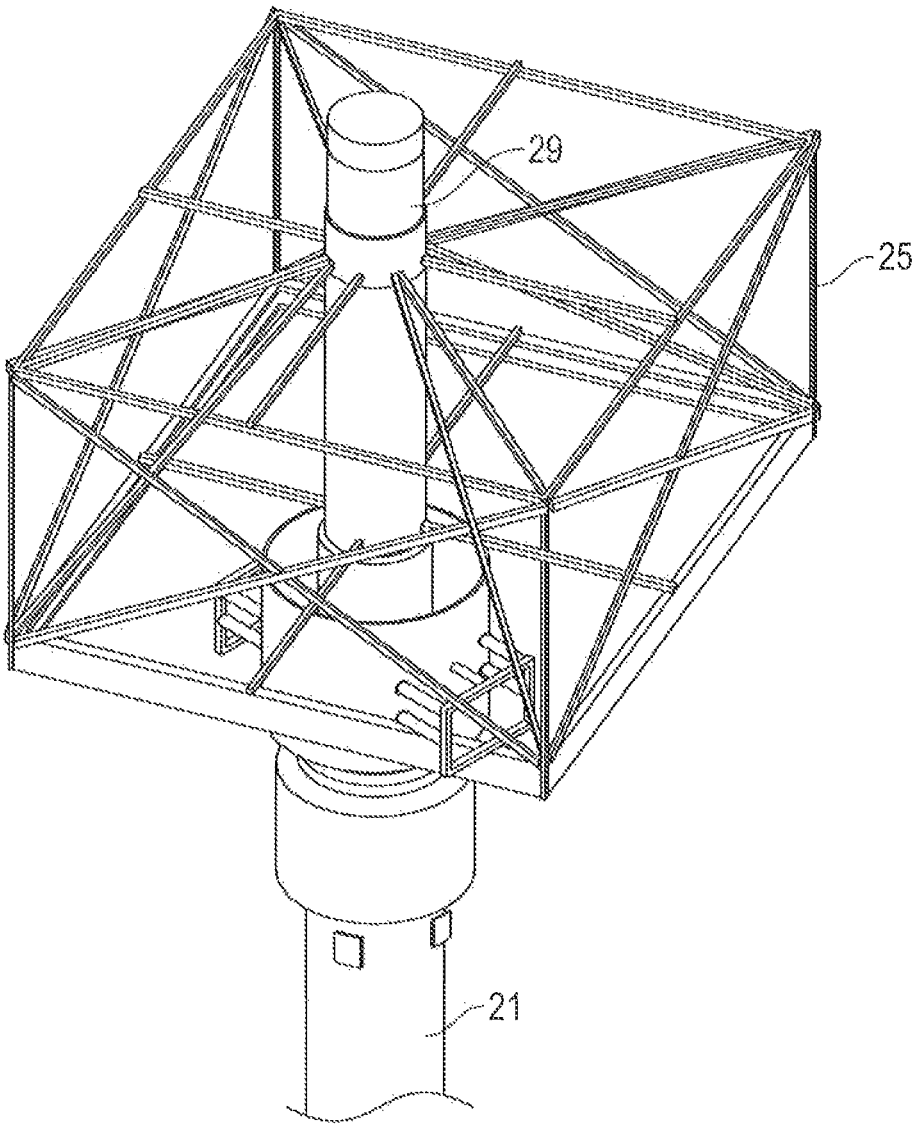
FIGS. 10*a*-10*n* are sequential illustrations of the deployment and installation of the clamping assembly of FIG. 3.
Figure 10B:
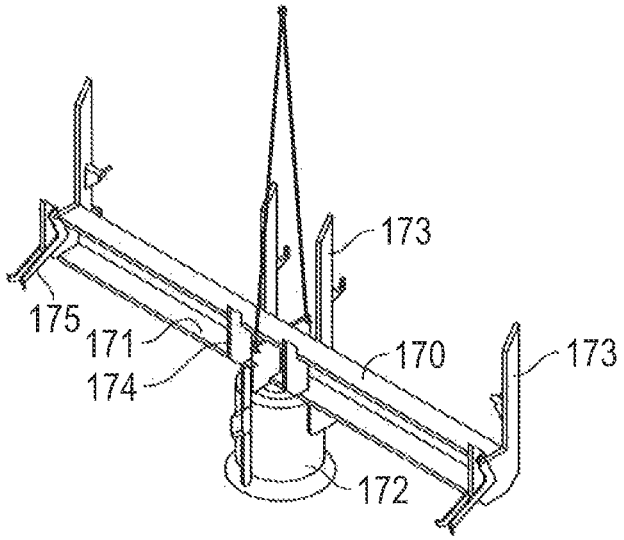
Figure 10B:
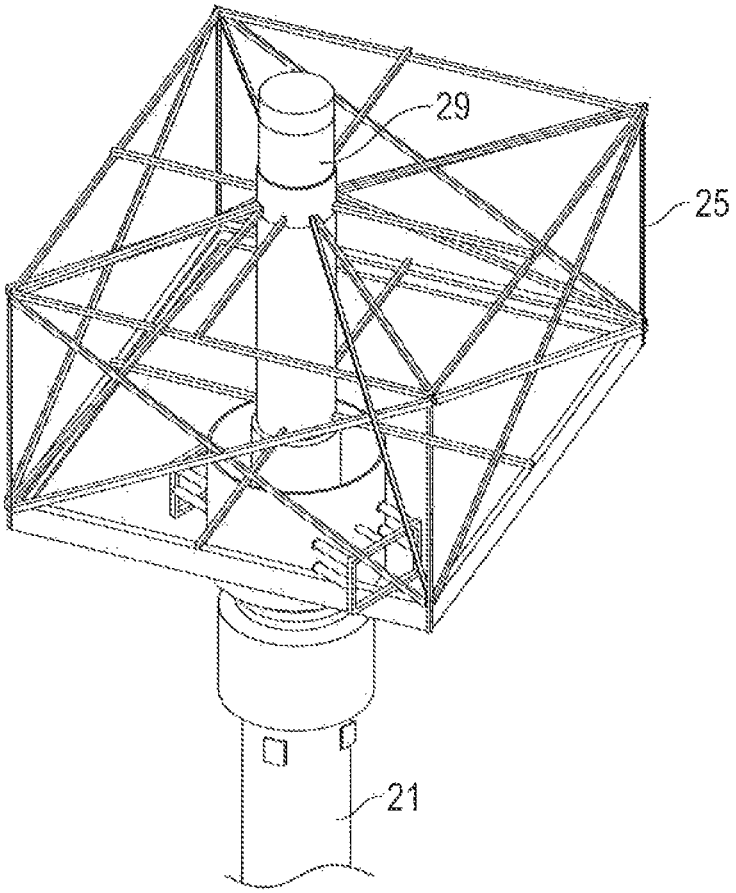
Figure 10C:
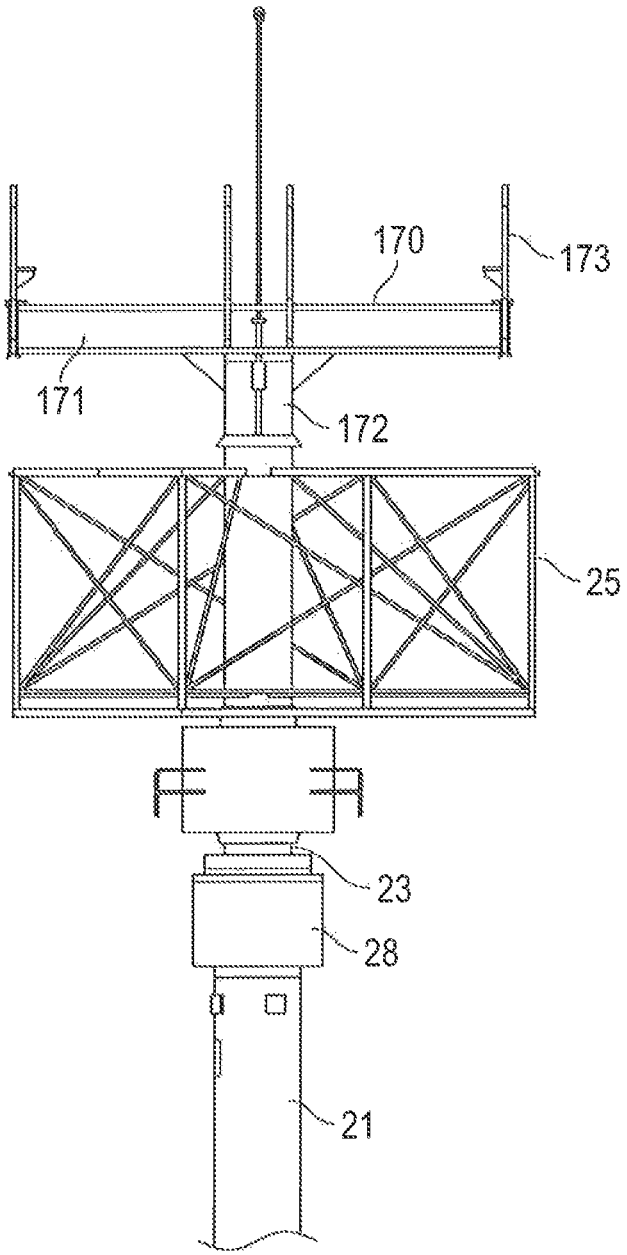
Figure 10D:
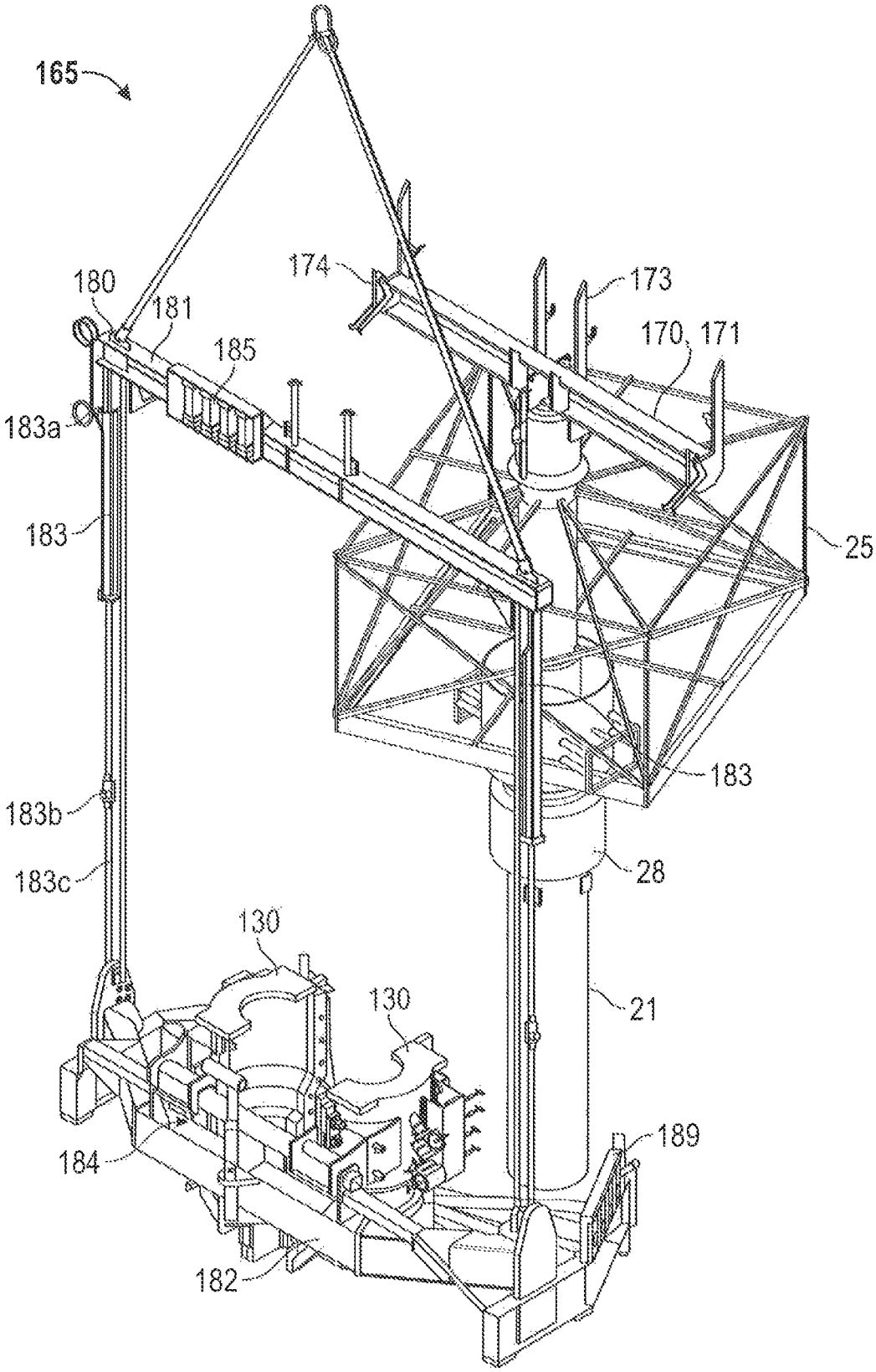
Figure 10E:
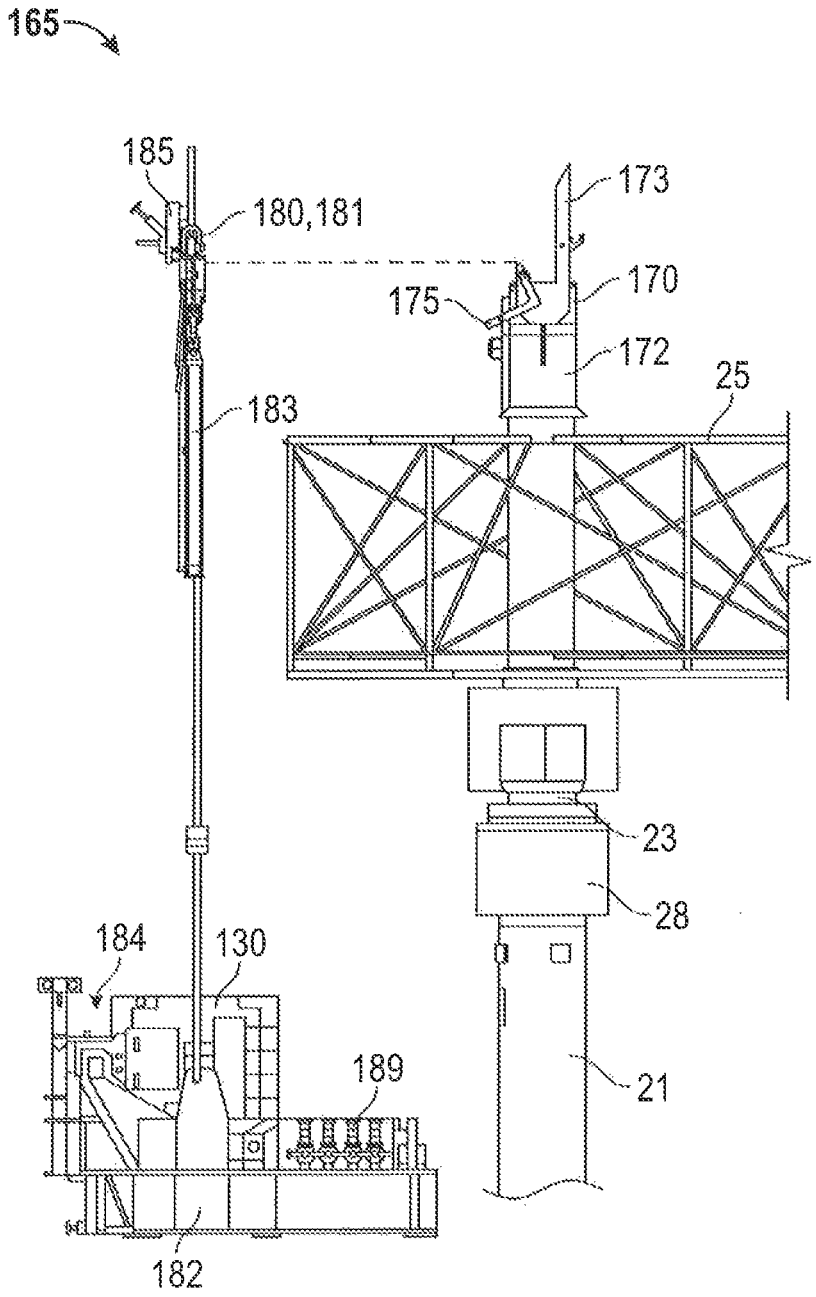
Figure 10F:
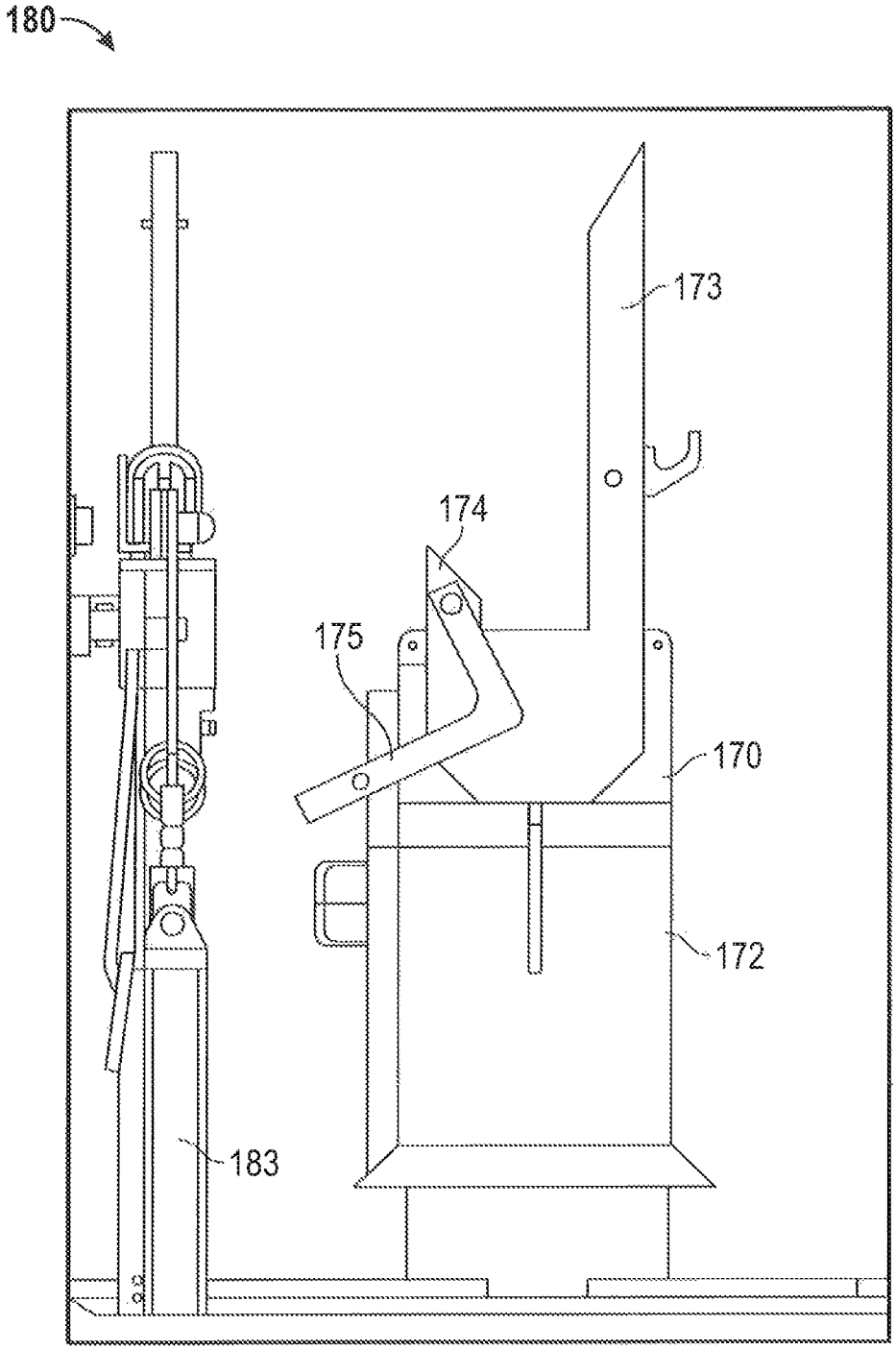
Figure 10G:
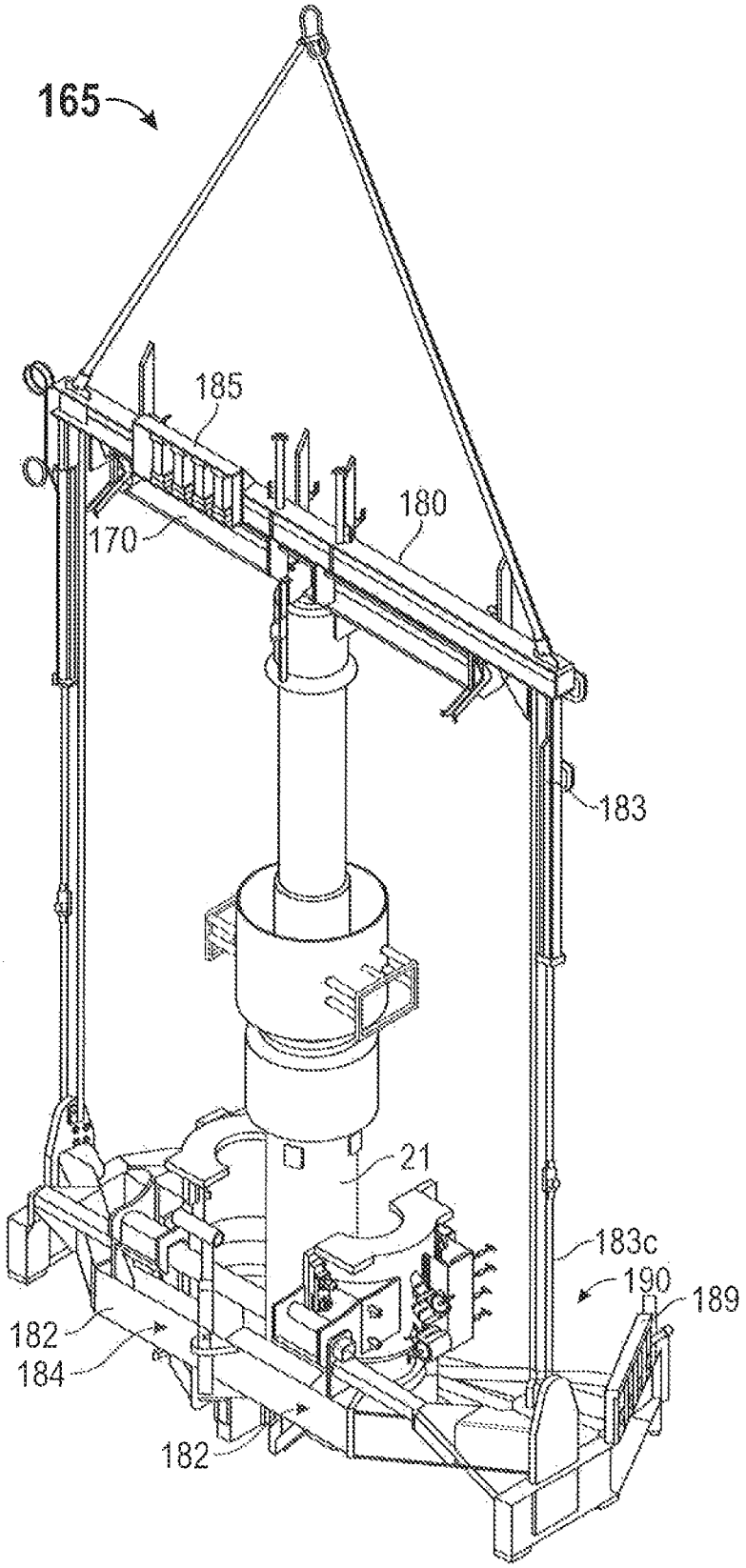
Figure 10H:
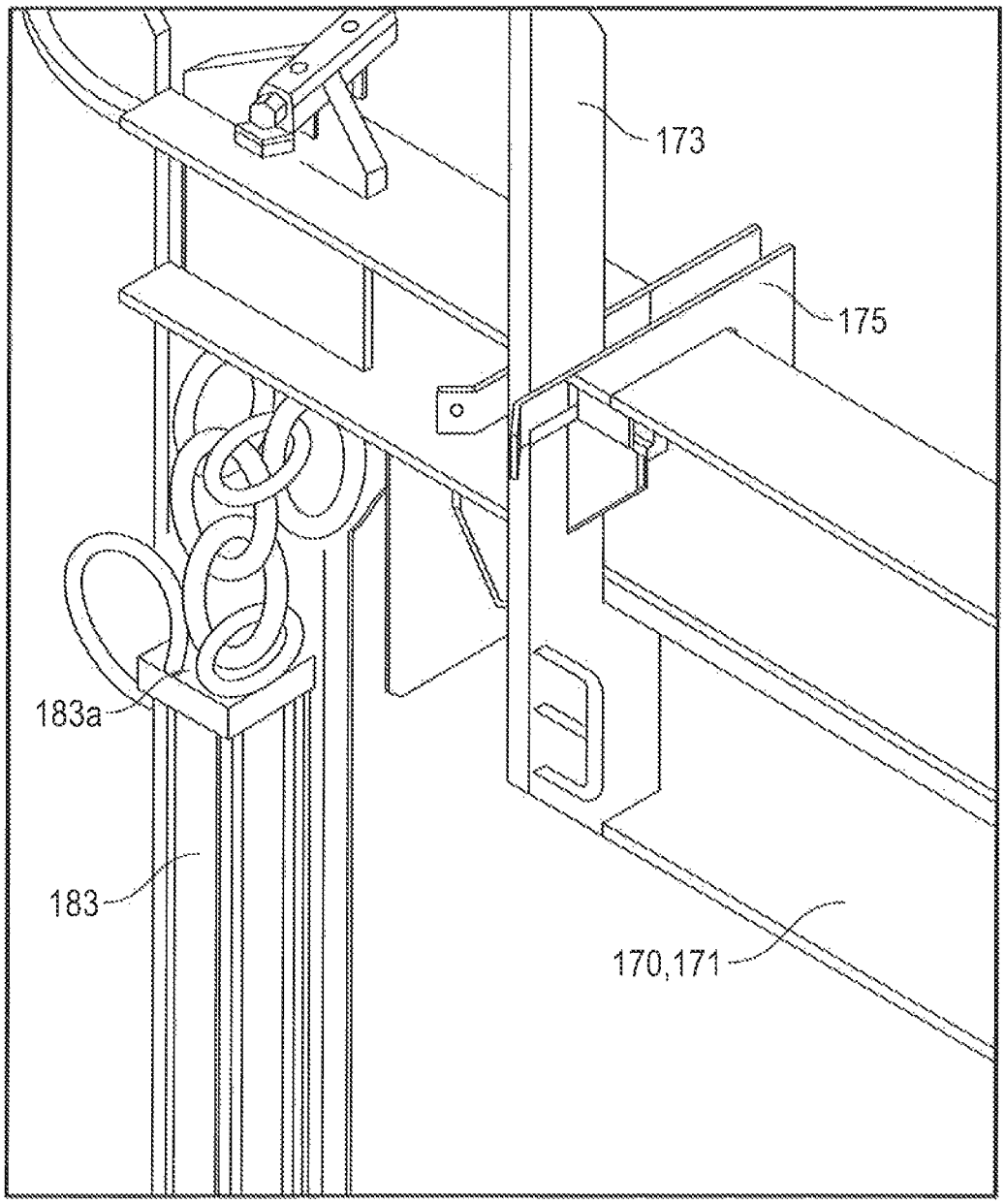
Figure 10I:
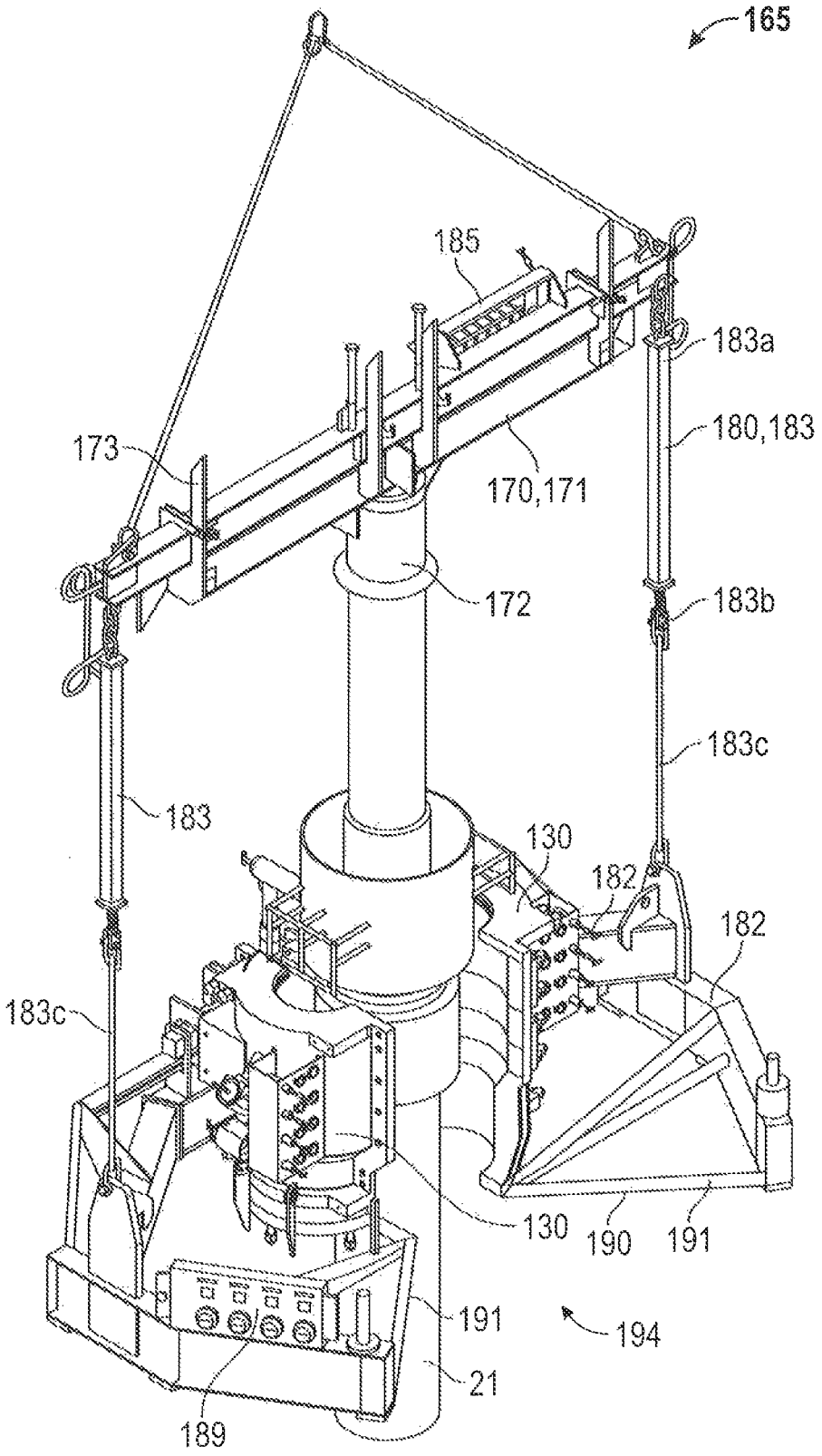
Figure 10J:
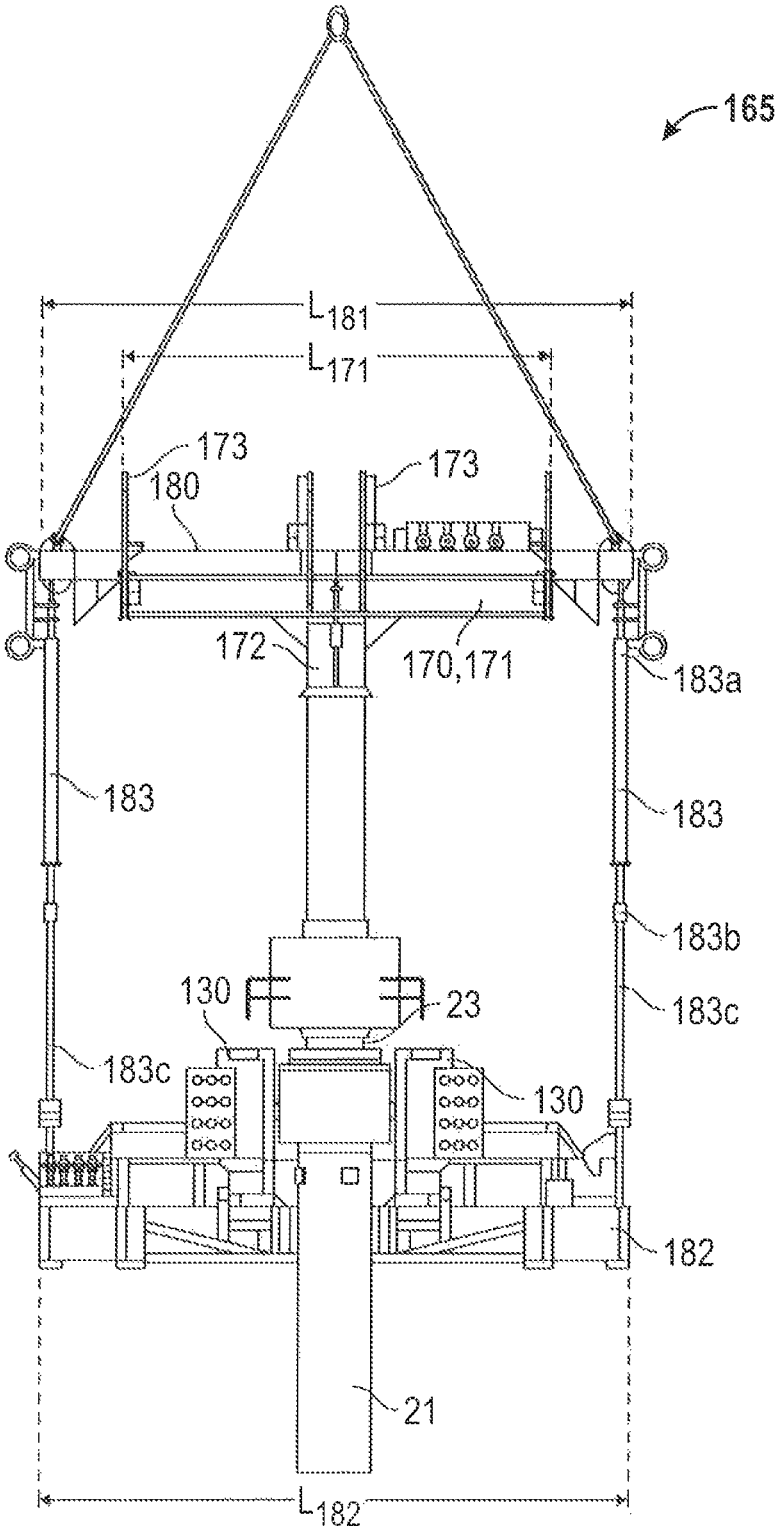
Figure 10K:
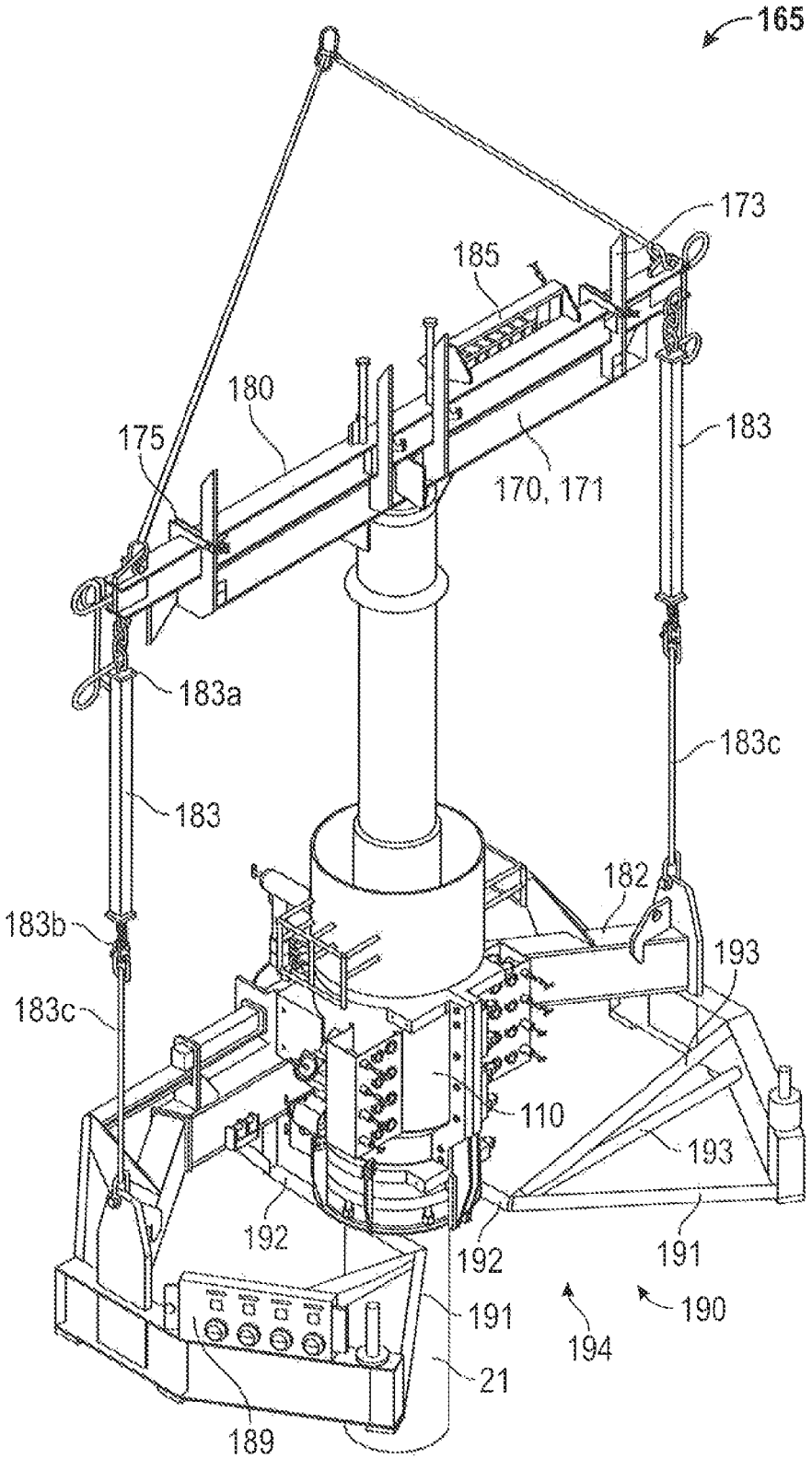
Figure 10L:
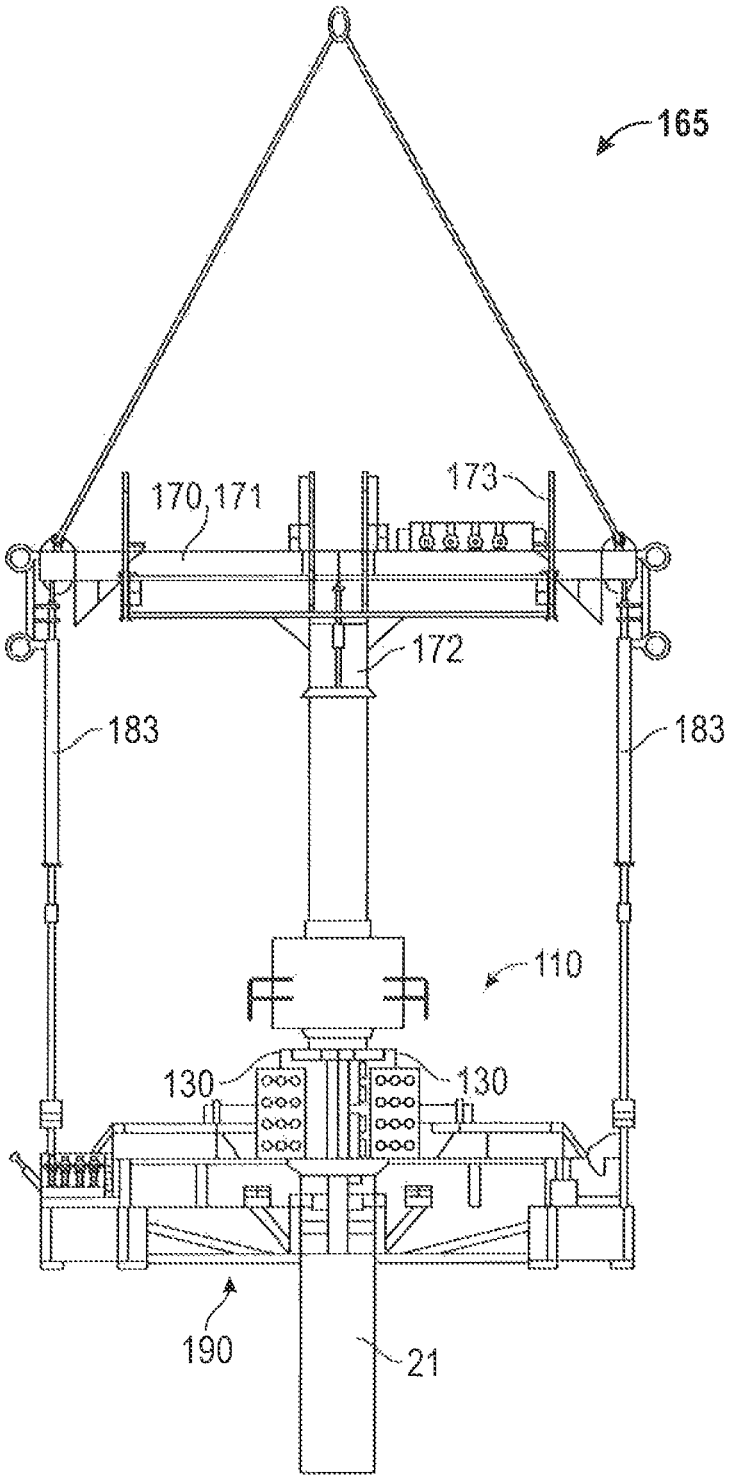
Figure 10M:
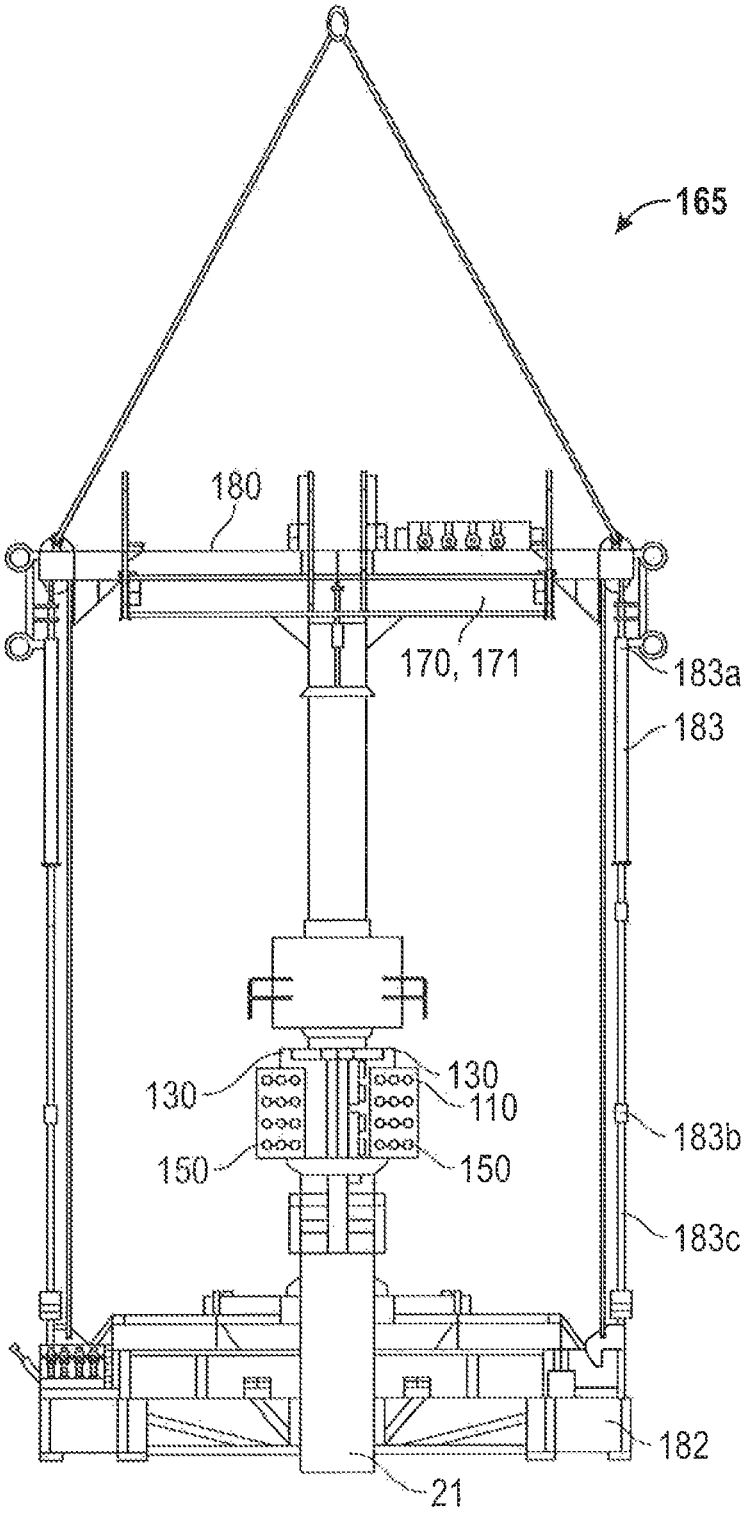
Figure 10N:
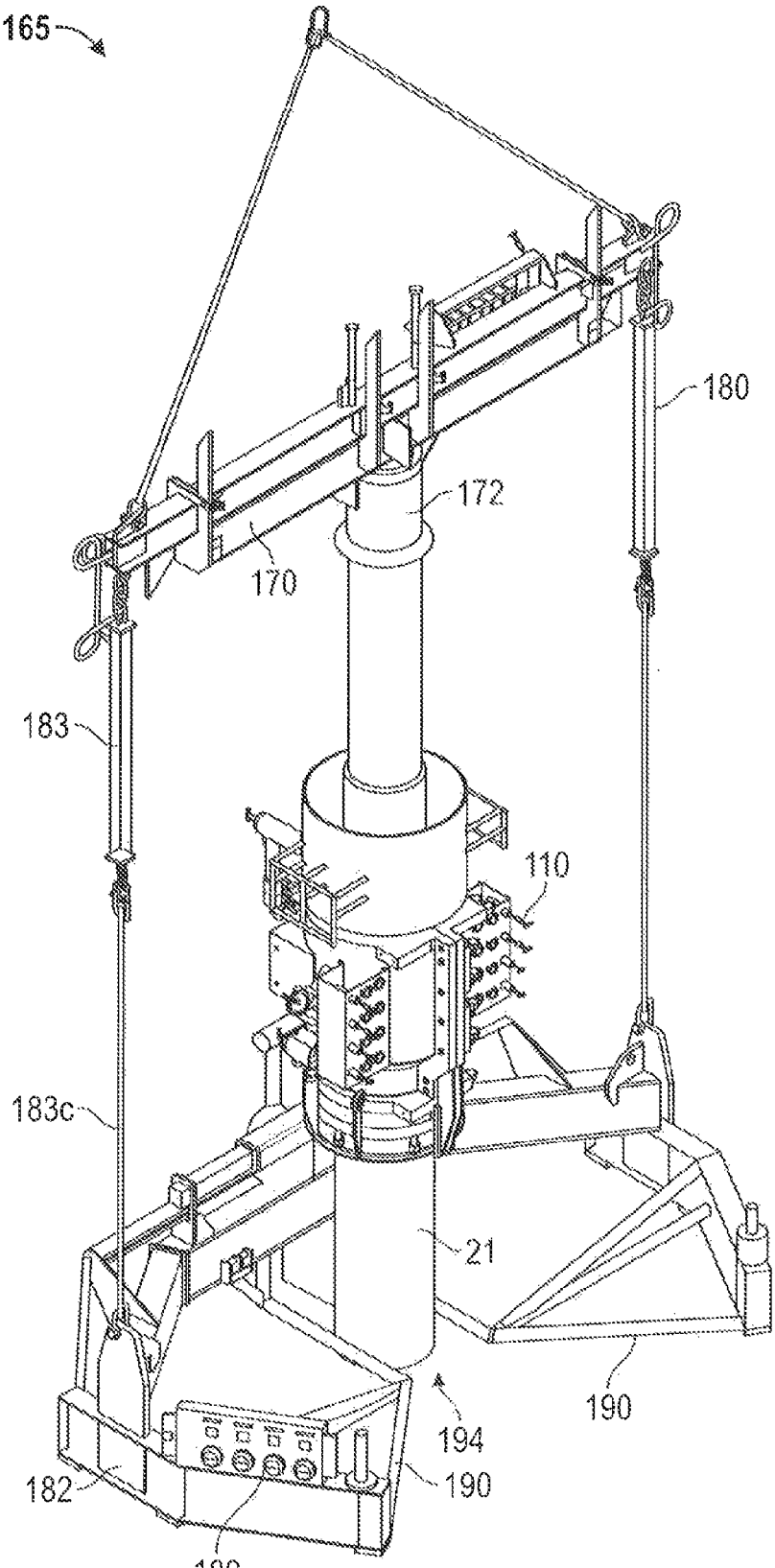

FIGS. 10*a*-10*n* illustrate the subsea deployment and installation of clamp assembly 110. Production tree 25 is mounted to inner wellhead housing 23 as previously described, however, for purposes of clarity, tree 25 is not shown in FIGS. 10*g* and 10*i*-10*n*. Although clamp assembly 110 is installed on subsea well 10, which includes production tree 25, it should be appreciated that clamp assembly 110 can also installed on wells that do not include production trees. In this embodiment, clamp assembly 110 is deployed and installed with a deployment system 165 comprising an upper support member 170 and deployment rigging 180 as shown in FIGS. 10*d*, 10*e*, 10*g*, and 10*i*-10*n*. Upper support member 170 and deployment rigging 180 will now be described, followed by the deployment and installation procedures using system 165.

Figure 11:
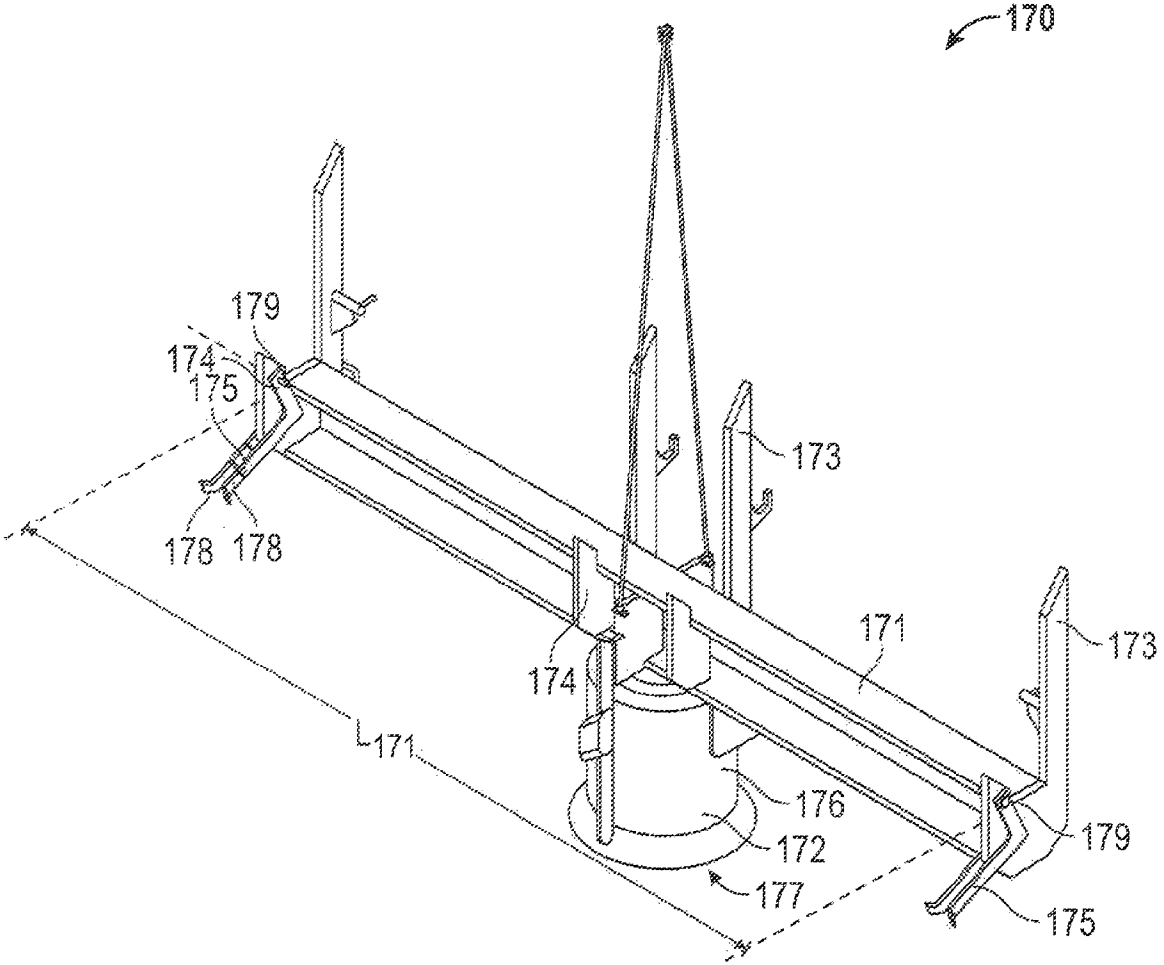
FIG. 11 is a perspective view of the upper support member of FIG. 10*b;*

Referring now to FIG. 11, upper support member 170 comprises an elongate support beam 171, a mandrel connector 172 secured to beam 171, a plurality of guide arms 173 extending upward from one side of beam 171, a plurality of retention arms 174 extending upward from the opposite side of beam 171, and a pair of locking members 175 rotatably coupled to two arms 174. Support beam 171 has a length $L_{171}$. Mandrel connector 172 is centered along the length of beam 171 and attached to the underside of beam 171. In this embodiment, mandrel connector 172 comprises a cylindrical housing 176 including a receptacle 177 extending from its lower end and configured to slidingly receive the upper end of mandrel 29.

Arms 173, 174 are rigidly secured to beam 171. In particular, a first pair of arms 173 are positioned proximal the lengthwise center of beam 171 and equidistant from the lengthwise center of beam 171, whereas a second pair of arms 173 are positioned at the ends of beam 171 equidistant from the lengthwise center of beam 171. One arm 174 is positioned opposite each arm 173. Each locking member 175 comprises a pair of spaced apart L-shaped brackets 178 rotatably coupled to arms 174 at the ends of beam 171. In particular, each bracket 178 is disposed on opposite sides of the corresponding arm 174, and a pin 179 extends through arm 174 and one end of each bracket 178. Thus, the gap between brackets 178 is aligned with and configured to receive the opposed arm 173 when brackets 178 are rotated about pin 179.

Moving now to FIGS. 10*d*, 10*e*, 10*i*, and 10*j*, rigging 180 includes an upper spreader bar 181, a lower generally C-shaped support frame 182, a pair of linear actuators 183, and a clamp makeup assembly or mechanism 184 coupled to lower support frame 182. As best shown in FIG. 10*j*, upper spreader bar 181 has a length $L_{181}$ greater than length $L_{171}$ of support beam 171. In addition, lower support frame 182 has a lateral width $W_{182}$ that is equal to length $L_{181}$.

Spreader bar 181 and support frame 182 are vertically spaced apart, however, the vertical distance between bar 181 and frame 182 can be adjusted with actuators 183. In particular, each actuator 183 has an upper end 183*a* coupled to one end of upper spreader bar 181 and a lower end 183*b* coupled to one end of lower support frame 182 with a flexible cable 183*c*. Each actuator 183 is configured to vertically extend and retract, thereby lowering and raising, respectively, the corresponding end of lower support frame 182 relative to the corresponding end of upper spreader bar 181. Actuators 183 are preferably operated in tandem such that the ends of lower support frame 182 are raised and lowered together to ensure lower support frame 182 remains substantially horizontal are parallel to upper spreader bar 181 during deployment and installation operations. In general, actuators 183 may comprise any suitable type of linear actuator known in the art such as a hydraulic cylinder. In this embodiment, an ROV panel 185 is mounted to upper spreader bar 181 for supplying hydraulic pressure to actuators 183 and operating actuators 183.

Figure 12:
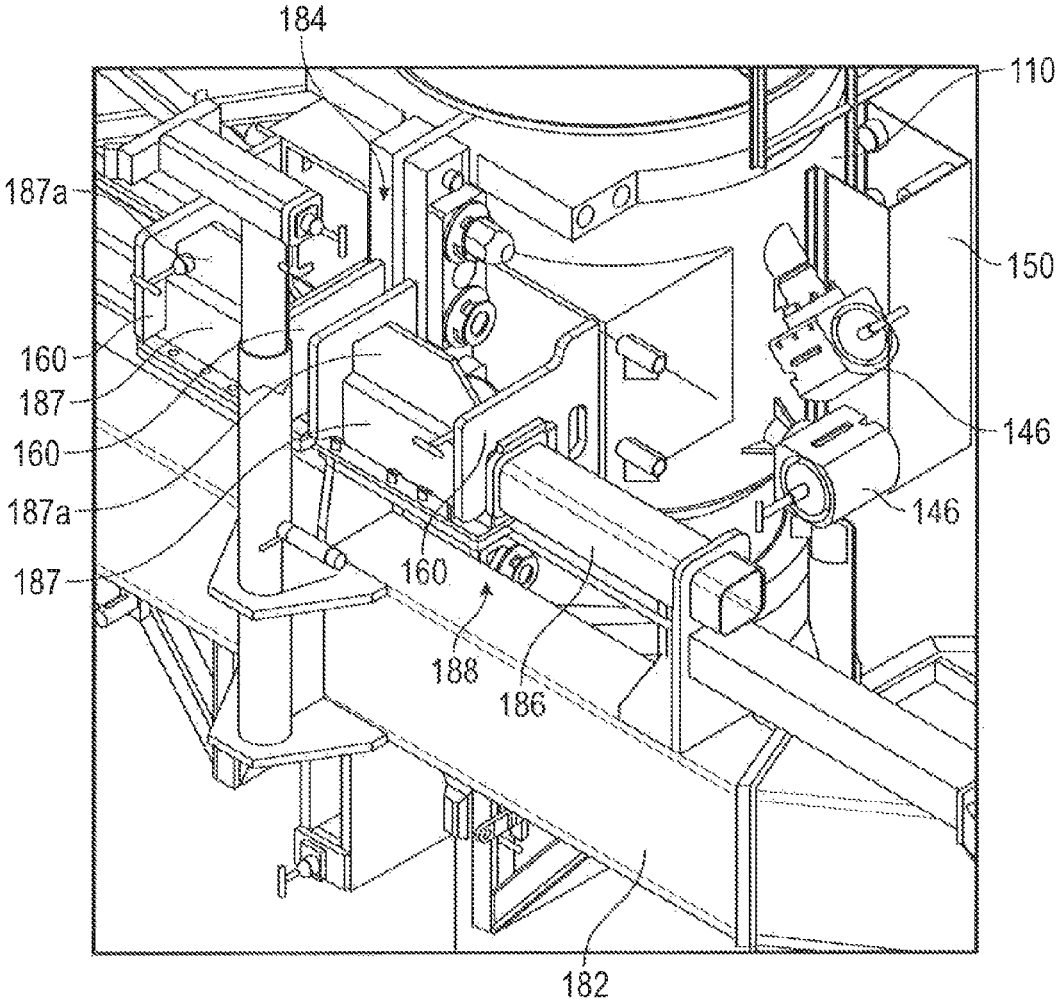
FIG. 12 is an enlarged perspective view of the makeup assembly of the deployment rigging of FIG. 10*d;*

Referring now to FIG. 12, clamp makeup assembly 184 includes an elongate tubular guide member 186, a pair of sleeves 187 slidably mounted to guide member 186, and a drive mechanism 188 that moves sleeves 187 linearly along guide member 186. Guide member 186 is oriented parallel to support frame 182, is spaced slightly above support frame 182, and has ends coupled to support frame 182. Drive mechanism 188 is coupled to sleeves 187 and support frame 182 and, as noted above, moves sleeves 187 along guide member 186. In particular, drive mechanism 188 is configured to move sleeves 187 together and apart relative to the center of guide member 186 and support frame 182. In general, drive mechanism 188 may comprise any device or assembly for moving sleeves 187 together and apart along guide member 186. For example, drive mechanism 188 may comprise a pair of hydraulic cylinders. In this embodiment, an ROV panel 189 is mounted to lower support frame 182 for operating drive mechanism 188 (FIGS. 10*d*, 10*i*, and 10*k*).

Referring still to FIG. 12, a positioning plate 187*a* extends upward from each sleeve 187 and is oriented parallel to guide member 186. One half body 130 is releasably coupled to each sleeve 187. In particular, each sleeve 187 is received within support brackets 160 of the corresponding half body 130 with plate 187*a* disposed between brackets 160. Thus, as sleeves 187 are moved along guide member 186, plates 187*a* abut brackets 160 and move half bodies 130 along with sleeves 187.

Referring now to FIGS. 10*i* and 10*k*, in this embodiment, a guidance system 190 is provided on lower support frame 182 to facilitate the positioning of primary conductor 21 between half bodies 130. Guidance system 190 includes a pair of guide rails 191 coupled to the ends of support frame 182, a pair of centralizing rails 192, extending between guide rails 191 and support frame 182, and a plurality of support arms 193 extending from support frame 182 to rails 191, 192. Each guide rail 191 extends inward from one end of C-shaped support frame 182, and each centralizing rail 192 extends from the inner end of one guide rail 191 to C-shaped support frame 182. Support arms 193 support rails 191, 192 and hold them rigidly in position. Guide rails 191 are positioned and oriented to form a funnel 194 at the open region or mouth of C-shaped support frame 182. Centralizer rails 192 are parallel to each other, spaced apart a distance slightly greater than the diameter of primary conductor 21, and disposed between half bodies 130. As will be described in more detail below, support frame 182 is positioned and advanced to receive primary conductor 21 within funnel 194. As primary conductor 21 moves into support frame 182, guide rails 191 slidingly engage conductor 21 and guide conductor 21 between centralizer rails 192. Continued advancement of support frame 182 moves primary conductor 21 between centralizer rails 192 and half bodies 130.

Referring now to FIGS. 10*a*-10*n*, the deployment and installation of clamp assembly 110 is shown. In general, upper support member 170 is lowered subsea and mounted to the upper mandrel 29 of production tree 25. Next, deployment rigging 180 is lowered subsea with half bodies 130 mounted thereto in a spaced apart arrangement, and temporarily coupled to upper support member 170 with half bodies 130 disposed on opposite sides of inner wellhead housing 23 and primary conductor 21. Half bodies 130 are then moved together and made up, thereby forming clamp assembly 110 around wellhead housing 23 and primary conductor 21. With clamp assembly 110 securely mounted to wellhead housing 23 and primary conductor 21, deployment rigging 180 is decoupled from half bodies 130 and support support member 170, and then retrieved to the surface. In FIGS. 10*a*-10*c*, upper support member 170 is shown being lowered subsea and mounted to mandrel 29 of production tree 25; in FIGS. 10*d*-10*e*, half bodies 130 are shown being lowered subsea on rigging 180 and aligned with primary conductor 21 below wellhead housings 20, 23; in FIGS. 10*f*-10*h*, rigging 180 is shown being mounted to upper support member 170 with half bodies 130 disposed on either side of primary conductor 21; in FIGS. 10*i*-10*j*, half bodies 130 are shown being moved upward with rigging 180 to position them on opposite sides of inner wellhead housing 23 and primary conductor 21 at the desired mounting location; in FIGS. 10*k*-101, half bodies 130 are shown being moved together and made up to sealingly engage inner wellhead housing 23 and primary conductor 21 above and below, respectively, cement ports 27 and isolation sleeve 28; and in FIG. 10*m*-10*n*, rigging 180 is shown being decoupled from clamp assembly 110.

As will be described in more detail below, rigging 180 initially positions half bodies 130 around primary conductor below cement ports 27 and sleeve 28, and then raises half bodies 130 into the desired position spanning ports 27 and sleeve 28, after which half bodies 130 are made up to form clamp assembly 110. Thus, sufficient clearance is preferably provided below ports 27 and sleeve 28 to enable half bodies 130 to be raised into position. Since ports 27 and sleeve 28 will typically be positioned at or proximal the mud line, the region of the sea floor surrounding primary conductor 21 may need to be dug up and dredged to provide the necessary clearance prior to the positioning of half bodies 130 around primary conductor 21. In addition, any surface irregularities on primary conductor 21 that may inhibit the ability of clamp assembly 110 to sealingly engage conductor 21 are preferably addressed prior to deployment and installation of clamp assembly 110. For example, the outer surface of primary conductor 21 may be ground smooth to ensure good sealing engagement with seal element 126.

Referring first to FIGS. 10*a*-10*c*, support member 170 is lowered subsea from a surface vessel using wireline or cable. Housing 176 is coaxially aligned with mandrel 29 of production tree 25, and is lowered to receive mandrel 29 within receptacle 177, thereby coupling upper support member 170 to mandrel 29. The length $L_{171}$ of beam 171 is greater than the lateral width of production tree 25, and thus, the ends of beam 171 extend laterally beyond the periphery of production tree 25. With support member 170 mounted to mandrel 29, the wireline is disconnected and retrieved to the surface.

Moving now to FIGS. 10*d* and 10*e*, half bodies 130 are spaced apart and mounted to sleeves 187 as previously described, and rigging 180 is lowered subsea from a surface vessel with wireline or cable connected to upper spreader bar 181. Rigging 180 is positioned laterally adjacent production tree 25 with upper spreader bar 181 oriented parallel to support member 170 and vertically positioned slightly above support member 170, support frame 182 below the desired mounting position on inner wellhead housing 23 and conductor 21, and funnel 194 aligned with primary conductor 21.

As shown in FIGS. 10*f*-10*h*, rigging 180 is moved laterally to receive production tree 25 between linear actuators 183 and cables 183*c*, to receive primary conductor 21 between centralizer rails 192 and half bodies 130, and to position upper spreader bar 181 immediately above upper support member 170. Funnel 194 facilitates the positioning of primary conductor 21 between centralizer rails 192 and half bodies 130 as previously described. Upper spreader bar 181 can be moved laterally over support member 170 until it abuts guide arms 173, and then lowered downward between arms 173, 174 to seat bar 181 atop support member 171. As previously described, the length $L_{181}$ of upper spreader bar 181 is greater than the length $L_{171}$ of beam 171, and thus, the ends of upper spreader bar 181 extend laterally beyond the ends of beam 171. With spreader bar 181 seated atop support member 171, locking members 175 are rotated upward about pins 179 to receive the corresponding arms 174 between brackets 178. As a result, locking members 175 are disposed around upper spreader bar 181 and help maintain upper spreader bar 181 in position between arms 173, 174.

Moving now to FIGS. 10*i* and 10*j*, with conductor 21 positioned between half bodies 130, linear actuators 183 raise lower support frame 182 upward to position half bodies 130 at the desired installation location about inner wellhead housing 23 and primary conductor 21. Next, half bodies 130 are moved together with sleeves 187 and drive mechanism 188, and made up as previously described to form body 111 and sealingly engage inner wellhead housing 23 and primary conductor 21. Once clamp assembly 110 is mounted to housing 23 and conductor 21, linear actuators 183 lower support frame 182 from half bodies 130 as shown in FIGS. 10*m* and 10*n*. With support frame 182 sufficiently spaced below clamp assembly 110, locking members 175 are rotated about pins 179 away from upper spreader bar 181, thereby enabling rigging 180 to be lifted, moved laterally away from support member 170, production tree 25, and well 10, and retrieved to the surface.

In the manner described, clamp assembly 110 is deployed subsea and mounted to inner wellhead housing 23 and primary conductor 21. One or more subsea ROVs may be employed during deployment and installation of clamp assembly 110 to aid in positioning of upper support member 170 and/or rigging, the disconnection and/or connection of the deployment wirelines, the operation of actuators 183 and drive mechanism 188, etc.

Figure 13:
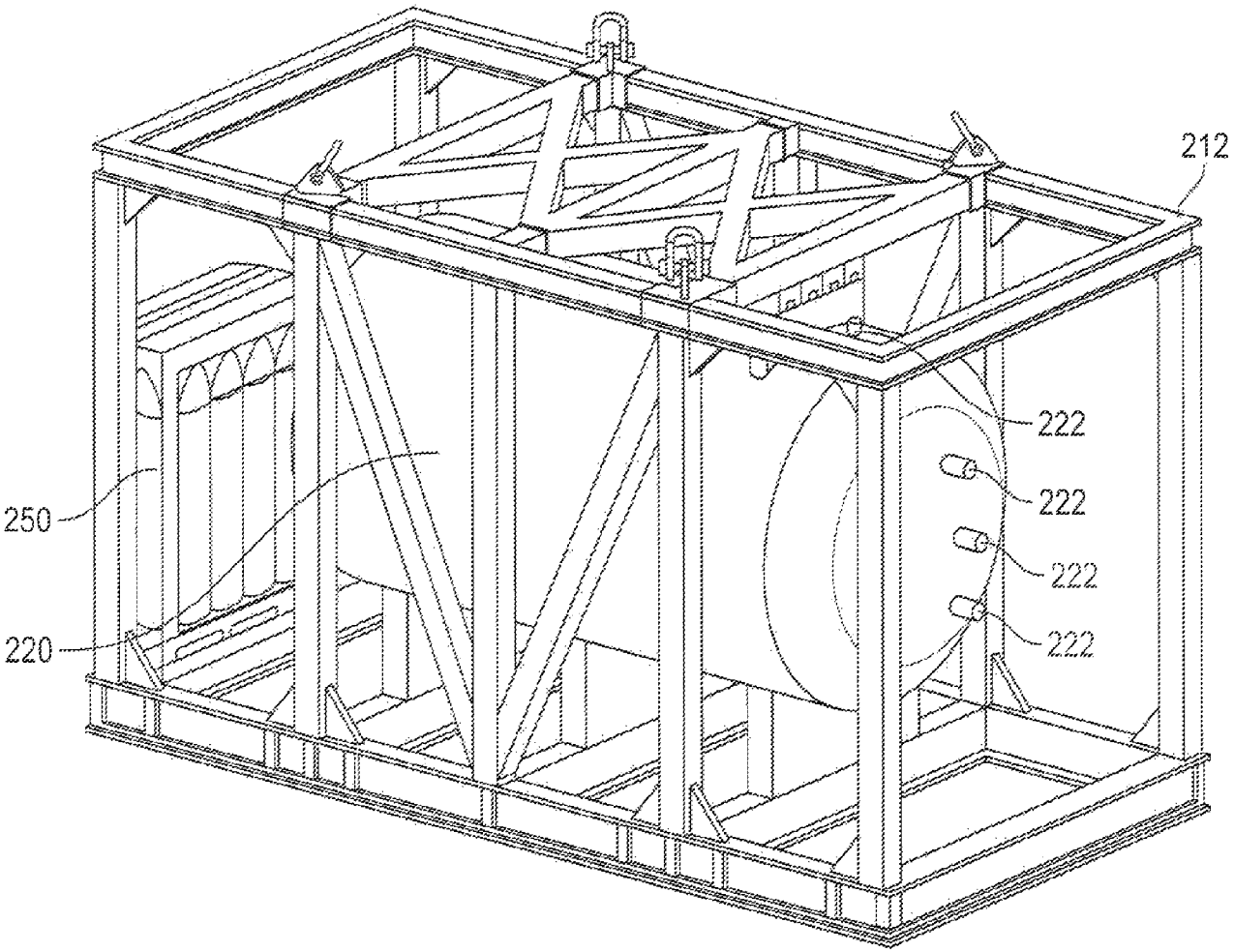
FIG. 13 is a perspective view of one of the storage tank assemblies of FIG. 3.

Referring now to FIGS. 3 and 13, fluids leaked from cement ports 27 and/or around isolation sleeve 28 are captured by clamp assembly 110 and diverted to storage system 200 via two jumpers 106. In this embodiment, storage system 200 includes three storage tank assemblies 210 connected in series with jumpers 106. Each tank assembly 210 includes a mud mat 211, a rigid frame 212 disposed on mud mat 211, a storage vessel or tank 220 disposed within and supported by frame 212, and a compensation system 250 coupled to tank 220 and mounted to frame 212. As will be described in more detail below, storage tanks 220 are designed to receive, capture, and contain leaked fluids diverted from clamp assembly 110, and compensation systems 250 are designed to provide added storage volume to accommodate increases in the volume of fluids within tanks 220 resulting from expansion when tank assemblies 210 are recovered to the surface. In this embodiment, each tank assembly 210 is identical, and thus, one tank assembly 210 will be described it being understood that the other tank assemblies 210 are the same.

Mud mat 211 distributes the weight of frame 212, tank 220, and compensation system 250 along the sea floor 11, thereby restricting and/or preventing them from sinking into the sea floor 11. In addition, mud mat 211 covers and shields the sea floor 11 from turbulence induced by subsea ROV thrusters, thereby reducing visibility loss due to disturbed mud during installation and operation. Frame 212 provides a rigid structure for protecting, as well as deploying and retrieving tank assembly 210. In particular, cables or wireline are coupled to frame 212 to lower tank assembly 210 subsea and recover tank assembly 210 to the surface.

Figure 14:
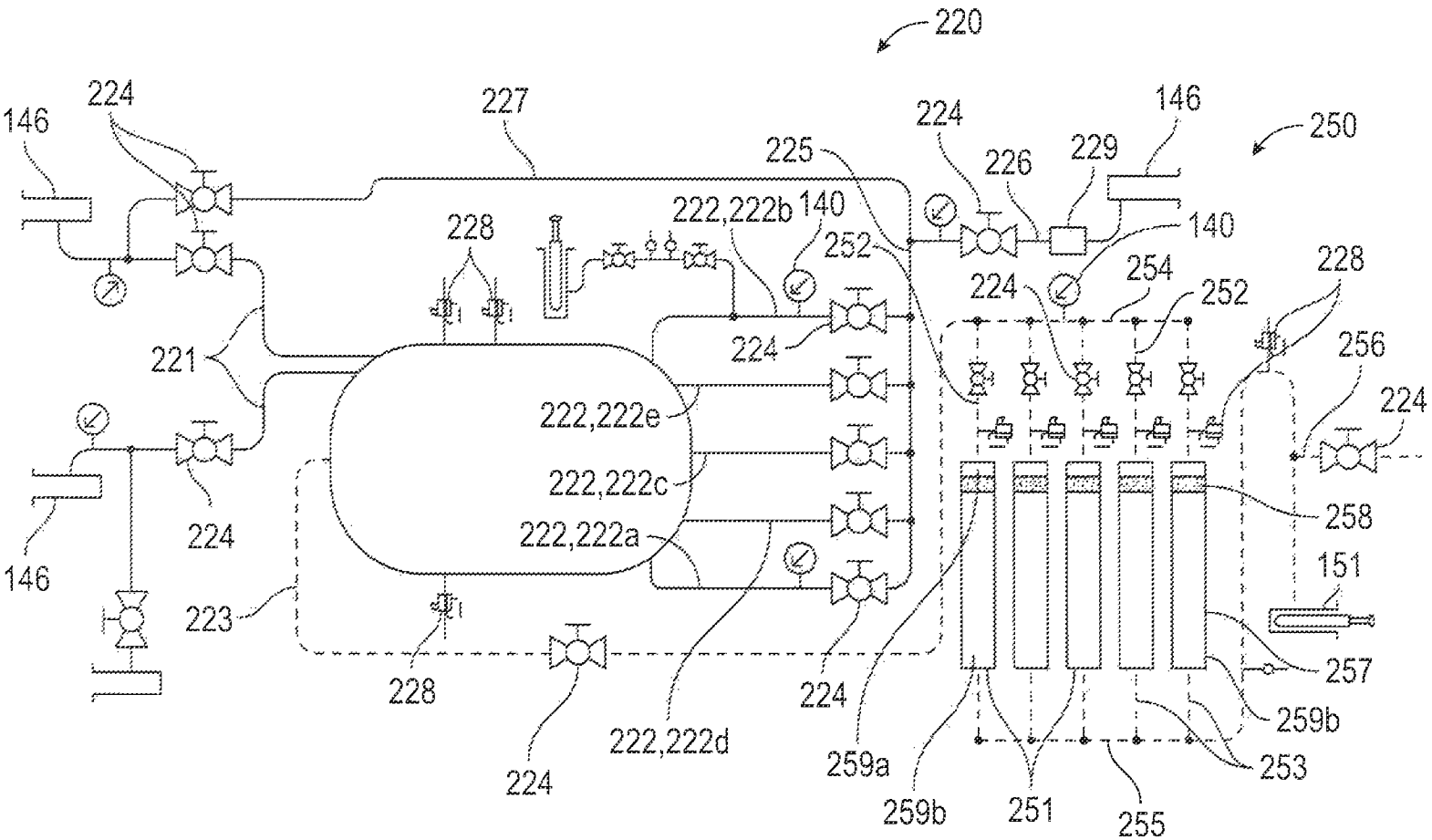
FIG. 14 is a schematic view of the storage tank and compensation system of the tank assembly of FIG. 13.
Figure 15:
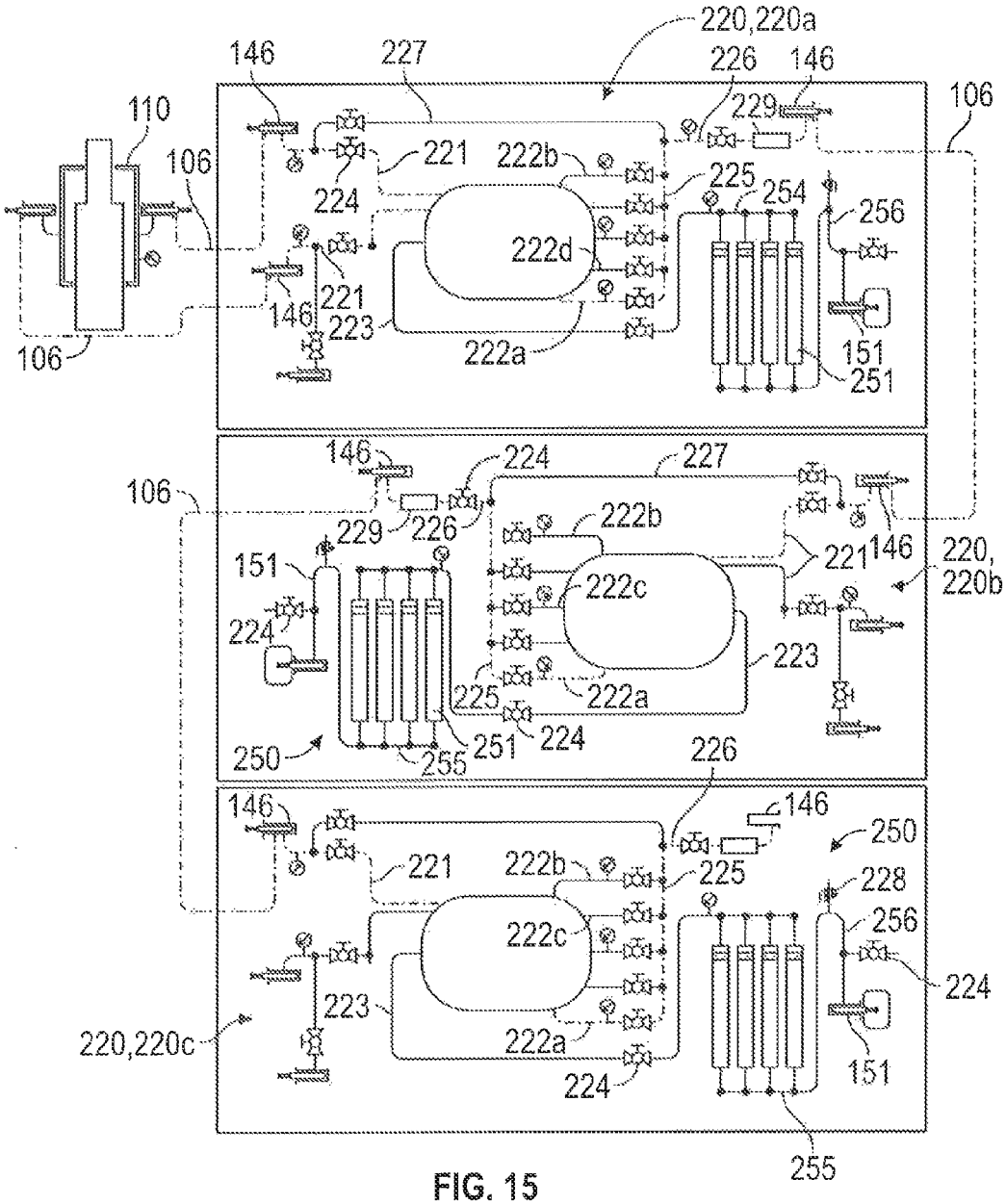
FIG. 15 is a schematic view of the storage system of FIG. 3.

Referring now to FIGS. 14 and 15, storage tanks 220 are designed to contain leaked fluids diverted from clamp assembly 110. In general, each tank 220 can have any suitable volume depending, at least in part, on the particular subsea application and anticipated volume of leaked fluids to be captured and contained. In this embodiment, each tank 220 is sized to hold a fluid volume of 250 barrels. In addition, in this embodiment, each storage tank 220 includes a pair of inlets 221, a plurality of vertically spaced outlets 222, and an outlet 223. Inlets 221 enable the communication of fluids into the corresponding tank 220, outlets 222 enable the communication of fluids from the corresponding tank 220 to another tank 220 or the surrounding environment, and outlet 223 enables the communication of fluids from the corresponding tank 220 to the associated compensation system 250. Each inlet 221 and each outlet 222, 223 is provided with a valve 224 that controls the flow of fluids therethrough. In general, each valve can be any suitable type of valve known in the art such as a ball valve.

As previously described, outlets 222 are vertically spaced between the bottom and top of the corresponding tank 220. More specifically, a first or lowermost outlet 222, labeled 222*a*, is vertically positioned at the bottom of tank 220, a second or uppermost outlet 222, labeled 222*b*, is vertically positioned at the top of tank 220, a third or middle outlet 222, labeled 222*c*, is vertically positioned in the middle of tank 220, a fourth or lower intermediate outlet 222, labeled 222*d*, is vertically positioned between outlets 222*a*, 222*c*, and a fifth or upper intermediate outlet 222, labeled 222*e*, is vertically positioned between outlets 222*b*, 222*c*. In this embodiment, outlets 222*a*, 222*b*, 222*c*, 222*d*, 222*e* of each tank 220 are connected to a common header or manifold 225, which in turn, is connected to an outlet 226 provided with a valve 224 as previously described. A flush/bypass conduit 227 including a valve 224 connects one inlet 221 with outlet 226. Each inlet 221 and outlet 226 is provided with a conduit coupling 146 as previously described for connection to a jumper 106. In addition, each inlet 221 and each outlet 222*a*, 222*b*, 222*c*, 225 is provided with a pressure gauge 140 that measures the fluid pressure therein.

Referring still to FIGS. 14 and 15, each tank 220 also includes a plurality of pressure relief devices 228 for protecting the corresponding tank 220 from over pressurization, thereby offering the potential to prevent a rupture or catastrophic failure. In this embodiment, three pressure relief devices 228 are connected to each tank 220—two pressure relief devices 228 are disposed at the top of each tank 220 and one pressure relief device 228 is connected to the bottom of tank 220. In general, pressure relief devices 228 may comprise any devices designed to vent and relieve pressure within tanks 220 at a predetermined pressure including, without limitation, pressure relief valves, pop-off valves, burst disc assemblies, or the like.

As will be described in more detail below, during subsea capture operations, fluids having different densities may reside in tanks 220 (e.g., liquid hydrocarbons, sea water, heavy mud, etc.). Depending upon the fluids in tanks 220 and the associated densities, tanks 220 can be reconfigured and adjusted via manipulation of valves 224 to optimize the displacement of sea water from one tank 220 to another and ensure leaked fluids diverted from clamp assembly 110 remain contained within storage system 200. In particular, by positioning outlets 222*a*, 222*b*, 222*c*, 222*d*, 222*e* at different vertical positions, different vertical regions of tanks 220 can be selectively accessed to enable a select fluid within a given tank 220 to be communicated downstream through system 200. To aid in the identification of the different types of fluids in tanks 220, and the relative vertical positions of the different fluids within tanks 220 (resulting from differences in fluid densities), each tank 220 is provided with fluid level indicators such as Galileo type fluid level indicators or fluid density type fluid level indicators as are known in the art. In addition, each outlet 226 is provided with a sight glass 229 for the visual identification of fluids flowing therethrough.

Referring still to FIGS. 14 and 15, each compensation system 250 includes a plurality of piston-cylinder assemblies 251, an inlet 252 connected to each assembly 251, and an outlet 253 connected to each assembly 251. Each inlet 252 and each outlet 253 includes a valve 224 as previously described for controlling fluid flow therethrough. In addition, each inlet 252 includes a pressure relief device 228 as previously described. For purposes of clarity, valves 224 and pressure relief devices 228 of each inlet 252 are not shown in FIG. 15.

Each inlet 252 is connected to a common inlet header or manifold 254, and each outlet 253 is connected to a common outlet header or manifold 255. Inlet header 254 is provided with a pressure gauge 140 that measures fluid pressure therein and is in fluid communication with outlet 223 of the corresponding tank 220. Outlet header 255 is provided with a conduit coupling 151 and a pressure relief device 228, each as previously described. An exhaust or vent line 256 including a valve 224 as previously described is connected to outlet header 255 between coupling 151 and outlets 253.

Each piston-cylinder assembly 251 includes a cylinder 257 and a piston 258 moveably disposed therein. Piston 258 divides cylinder 257 into two separate fluid chambers 259*a*, 259*b*, which are not in fluid communication. The volume of chambers 259*a*, 259*b* are inversely related—as piston 258 moves in one direction within cylinder 257, the volume of chamber 259*a* increases and the volume of chamber 259*b* decreases by the same amount, and as piston 258 moves in the opposite direction within cylinder 257, the volume of chamber 259*a* decreases and the volume of chamber 259*b* increases by the same amount. Each inlet 252 is in fluid communication with chamber 259*a* of the corresponding piston-cylinder assembly 251, and each outlet 253 is in fluid communication with chamber 259*b* of the corresponding piston-cylinder assembly 251. During deployment and subsea capture operations, chambers 259*a*, 259*b* are filled with sea water, and pistons 258 are positioned to minimize the volume of chambers 259*a* and maximize the volume of chambers 259*b*.

Referring now to FIGS. 3 and 15, storage system 200 is built along on the sea floor 11 by lowering each tank assembly 210 subsea from a surface vessel, and then connecting tank assemblies 210 with jumpers 106. As previously described, to deploy tank assemblies 210, cables or wireline are coupled to frames 212 and used to lower tank assemblies 210 from the surface (e.g., with a winch). One or more subsea ROVs may be employed during deployment of tank assemblies 210 to aid in their positioning. With tank assemblies 210 disposed on the sea floor 11, subsea ROVs connect tanks 220 with jumpers 106 and couplings 146. In this embodiment, storage system 200 includes three tanks 220 connected in series—a first tank 220, labeled 220*a*, is connected to a second tank 220, labeled 220*b*, with one jumper 106 extending between conduit coupling 146 of outlet 226 of first tank 220*a* and conduit coupling 146 of one inlet 221 of second tank 220*b*; and a third tank 220, labeled 220*c*, is connected to second tank 220*b* with a jumper 106 extending between conduit coupling 146 of outlet 226 of second tank 220*b* and conduit coupling 146 of one inlet 221 of third tank 220*c*. Upon deployment of tank assemblies 210, tanks 220 are allowed to flood with sea water.

With clamp assembly 110 mounted to inner wellhead housing 23 and primary conductor 21 as previously described, and storage system 200 constructed on the sea floor 11, subsea ROVs couple clamp assembly 110 and storage system 200. In particular, clamping assembly 210 is connected to first tank 220*a* of storage system 200 via a pair of jumpers 106 extending between conduit couplings 146 of clamp assembly 110 and conduit couplings 146 of inlets 221 of first tank 220*a*.

Referring now to FIGS. 15-19, as previously described, each tank 220*a*, 220*b*, 220*c* is initially filled with sea water. However, once storage system 200 is coupled to clamp assembly 110, subsea ROVs operate valves 224 to divert leaked fluids from annulus 105 within clamp assembly 110 into tanks 220, while simultaneously ensuring the leaked fluids are captured within tanks 220 and allowing the displaced sea water within tanks 220 to flow from tank-to-tank and vent into the surrounding sea through outlet 226 of third tank 220*c*. In particular, during leaked fluid capture operations, valve 224 of each inlet 221 connected to a jumper 106 is open, valve 224 of each inlet 221 not connected to a jumper 106 is closed, valve 224 of each outlet 226 is open, valve 224 of each bypass/flush conduit 227 is closed, valve 224 of each outlet 223 is closed, valve 224 of one select outlet 222 of each tank 220 (e.g., outlet 222*a*, 222*b*, 222*c*, 222*d*, 222*e*) is opened, and valves 224 of the other outlets 222 of each tank 220 are closed. The selection of which valve 224 of outlets 222 to open on each tank 220 will depend on the particular fluids in each tank 220 and the associated densities of such fluids. In general, for each tank 220 in system 200, valve 224 associated with outlet 222 that is vertically aligned with and in fluid communication with sea water within that tank 220 is open. If a given tank 220 only includes sea water, then valve 224 of any outlet 222 can be opened to allow the sea water to flow downstream.

The vertical location of sea water within each tank 220, and hence identification of the outlet 222 vertically aligned with the sea water within each tank 220, will depend on the types of fluids in each tank 220 and their relative densities. Fluids flowing from clamp assembly 110 to storage system 200 will typically include liquid hydrocarbons (e.g., oil), drilling fluids (e.g., heavy mud), and, at least initially, sea water. At typical subsea well depths, predominantly all of any captured gases (e.g., natural gas, etc.) will be dissolved in solution. Consequently, during capture operations, tanks 220 will likely be filled with sea water, liquid hydrocarbons, drilling fluids, or combinations thereof. Without being limited by this or any particular theory, liquid hydrocarbons are less dense than sea water, which is less dense than drilling fluids. Therefore, to the extent sea water and liquid hydrocarbons are in a given tank 220, the liquid hydrocarbons will reside above the sea water and to the extend sea water and drilling fluids are in a given tank 220, the drilling fluids will reside below the sea water.

Figure 16:
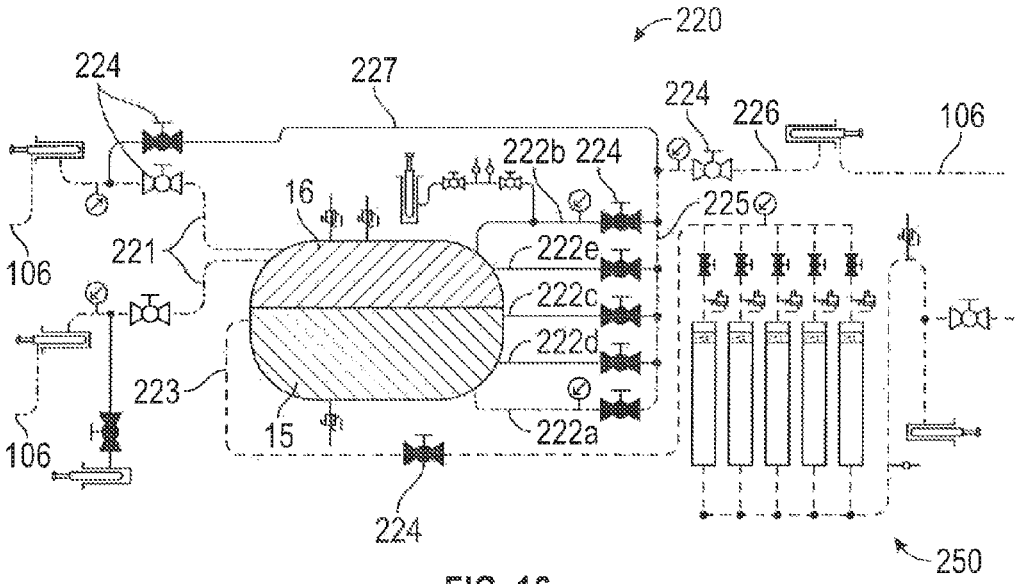
FIG. 16 is a schematic view of the storage tank of FIG. 14 filled with liquid hydrocarbons and sea water during subsea capture operations.
Figure 17:
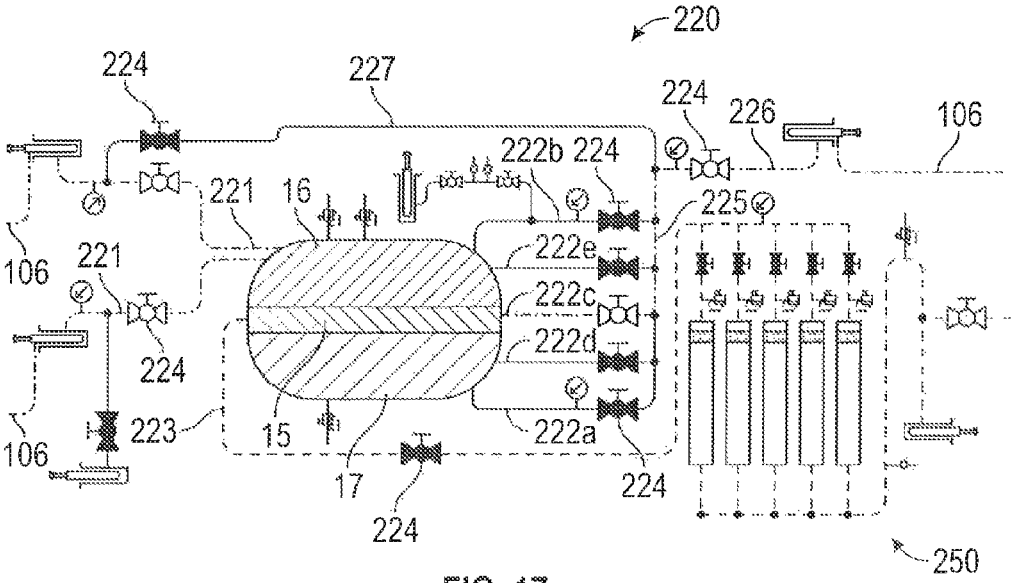
FIG. 17 is a schematic view of the storage tank of FIG. 14 filled with drilling fluids and sea water during subsea capture operations.
Figure 18:
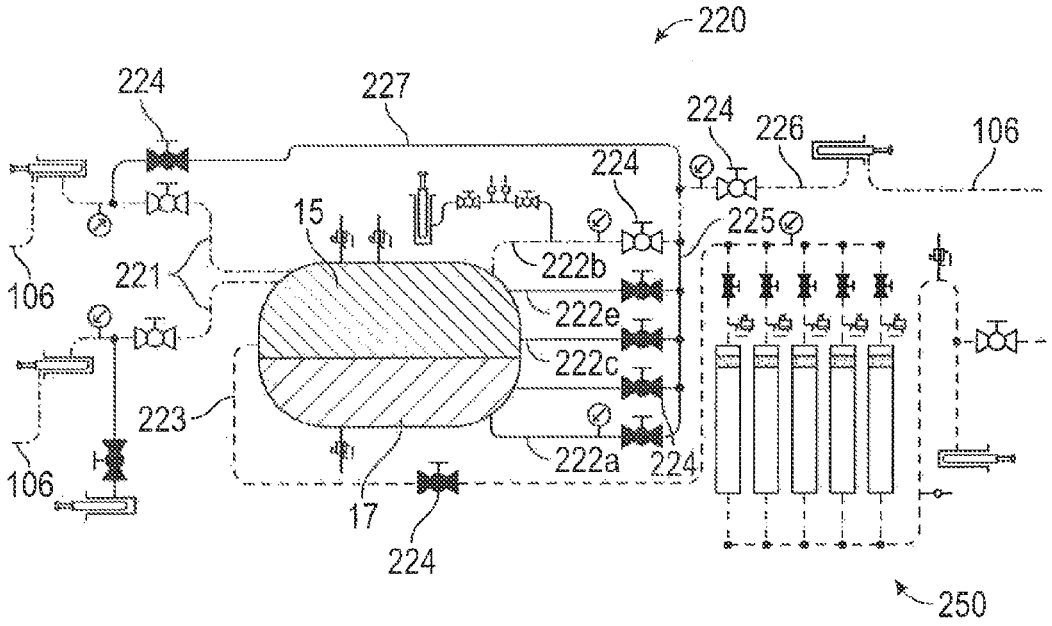
FIG. 18 is a schematic view of the storage tank of FIG. 14 filled with liquid hydrocarbons and sea water during subsea capture operations.

Referring now to FIGS. 16-18, exemplary tanks 220 are shown with different combinations of fluid constituents (e.g., sea water, hydrocarbon liquids, drilling mud, etc.). Open valves 224 are shown in white with a black outline, while closed valves 224 are colored completely black. In FIG. 16, exemplary tank 220 is filled with sea water 15 and liquid hydrocarbons 16 during capture operations; in FIG. 17, exemplary tank 220 filled with sea water 15, liquid hydrocarbons 16, and drilling fluid 17 during capture operations; and in FIG. 18, exemplary tank 220 is filled with sea water 15 and drilling fluid 17 during capture operations.

As shown in FIG. 16, exemplary tank 220 is filled with sea water 15 and liquid hydrocarbons 16. The sea water 15 is disposed below the less dense liquid hydrocarbons 16, and thus, valve 224 of the lowermost outlet 222*a* is open to allow only displaced sea water 15 in tank 220 to exit tank 220 through outlet 222*a* and outlet 226. As shown in FIG. 17, exemplary tank 220 is filled with sea water 15, liquid hydrocarbons 16, and drilling fluids 17. The sea water 15 is disposed between the less dense liquid hydrocarbons 16 and the more dense drilling fluids 17, and thus, valve 224 of the middle outlet 222*c* is open to allow only displaced sea water 15 to exit tank 220 through outlet 222*c* and outlet 226. As shown in FIG. 18, exemplary tank 220 is filled with sea water 15 and drilling fluids 17. The sea water 15 is disposed above the more dense drilling fluids 17, and thus, valve 224 of the uppermost outlet 222*b* is open to allow only displaced sea water 15 to exit tank 220 through outlet 222*b* and outlet 226.

In the manner described, during subsea capture operations sea water (e.g., sea water 15) displaced by captured fluids (e.g., liquid hydrocarbons 16 and drilling fluids 17) is passed from tank 220*a* to tank 220*b*, then from tank 220*b* to tank 220*c*, and finally from tank 220*c* to the surrounding sea via open outlet 226. To confirm the flow of fluids into system 200 from clamp assembly 110, the initial sea water in each tank 220 is preferably dyed with an environmentally friendly fluid such as floraseen so that the sea water exiting tank 220*c* into the surrounding sea water can be easily identified.

Since tanks 220*a*, 220*b*, 220*c* are arranged in series, first tank 220*a* captures and contains the leaked fluids until tank 220*a* is substantially or completely full of leaked fluids (i.e., there is little to no sea water within tank 220*a*), at which time the captured fluids are allowed to flow through (a) any one or more outlets 222 of first tank 220*a*, (b) header 225 and outlet 226 of first tank 220*a*, and (c) jumper 106 and inlet 221 of second tank 220*b* into second tank 220*b*. As captured fluids flow into second tank 220*b*, displaced sea water in second tank 220*b* is allowed to flow through (a) one outlet 222 of second tank 220*a* selected as previously described, (b) header 225 and outlet 226 of second tank 220*b*, and (c) jumper 106 and inlet 221 of third tank 220*c* into third tank 220*b*. This continues until second tank 220*b* is substantially or completely full of leaked fluids (i.e., there is little to no sea water within tank 220*b*), at which time the captured fluids are allowed to flow through (a) any one or more outlets 222 of second tank 220*b*, (b) header 225 and outlet 226 of second tank 220*b*, and (c) jumper 106 and inlet 221 of third tank 220*c* into third tank 220*c*. As captured fluids flow into third tank 220*c*, displaced sea water in third tank 220*c* is allowed to flow through (a) one outlet 222 of third tank 220*c* selected as previously described, and (b) header 225 and outlet 226 of third tank 220*c* into the surrounding sea. Tanks 220*a*, 220*b*, 220*c* are preferably sized to store the total anticipated volume of leaked fluids such that third tank 220*c* always includes at least some sea water. In the event the volume of leaked fluids greater than the total storage volume of tanks 220*a*, 220*b*, 220*c*, one or more additional tanks 220 may be deployed and connected in series with third tank 220*c* to increase to total storage volume of system 200. Thus, system 200 can be scaled up by adding tanks 220 and/or increasing the overall size of tanks 220.

Once tanks 220 are sufficiently full of captured fluids and/or the leak has ceased (e.g., as indicated by no more dyed sea water exiting third tank 220*c* into the surrounding sea), storage tank assemblies 210 are removed to the surface. To prepare tank assemblies 210 for removal, valve 224 of each inlet 221 is closed, valve 224 of each flush/bypass conduit 227 is closed, and valve 224 of each outlet 222, 226 is closed. However, valve 224 of each outlet 223 is open, valve 224 of each inlet 252 is open, and valve 224 of each vent line 256 is open. Thus, each tank 220 in fluid communication with chambers 259*a* of the corresponding compensation system 250, and each chamber 259*b* is in fluid communication with the outside environment. Next, jumpers 106 are disconnected from couplings 146 of tank assemblies 210, and wirelines or cables are lowered from the surface and coupled to frames 212. Tension is then applied to the wirelines (e.g., with a winch) to lift tank assemblies 210 to the surface. In general, tank assemblies 210 may be lifted at different times (e.g., one at a time) or simultaneously. One or more subsea ROVs may be employed during recovery of tank assemblies 210 to connect the wirelines to frames 212, monitor tank assemblies 210, etc.

Figure 19:
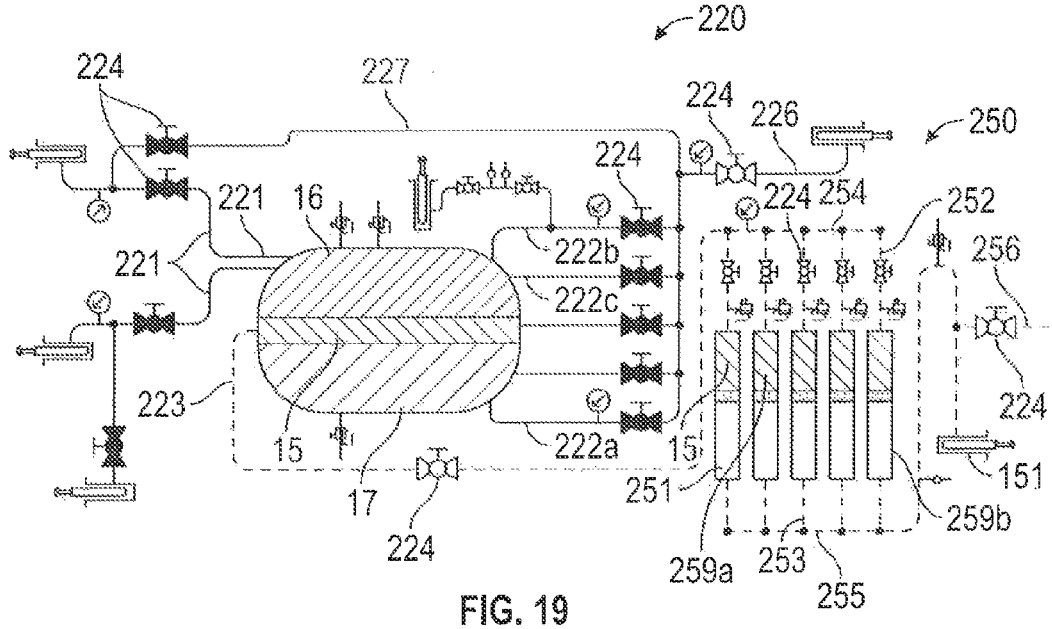
FIG. 19 is a schematic view of the storage tank and compensation system of FIG. 14 filled with liquid hydrocarbons, drilling fluids, and sea water during recovery to the surface.

As tank assemblies 210 are raised to the sea surface, the hydrostatic pressure decreases, and thus, the pressure differential experienced by each tank 220 increases. However, compensation systems 250 provides additional storage volume to relieve the pressure within the corresponding tanks 220, thereby offering the potential to reduce the likelihood of a rupture in a tank 220 and/or opening of a pressure relief device 228, both of which would undesirably result in leakage of captured fluids. In particular, chambers 259*a* are in fluid communication with tank 220, and thus, any fluids within chambers 259*a* have the same fluid pressure as the fluids within tank 220; and chambers 259*b* are in fluid communication with the outside environment, and thus, any fluids in chambers 259*b* have the same fluid pressure as the hydrostatic pressure. As a given tank assembly 210 is raised toward the surface, the fluid pressure within chambers 259*b* decreases. Pistons 258 move in response to the pressure differential between chambers 259*a*, 259*b*, thereby increasing the volume of chambers 259*a* and decreasing the volume of chambers 259*b*. Sea water within chambers 259*b* is simply vented to the outside environment through vent line 256. The increase in the volume of chambers 259*a* allows fluids within the corresponding tank 220 to expand and flow into chambers 259*a* via outlet 223, header 254, and inlets 252, resulting in an decrease in the fluid pressure within that tank 220. For example, FIG. 19 illustrates an exemplary tank 220 being recovered to the surface. Open valves 224 are shown in white with a black outline, while closed valves 224 are colored completely black. As the hydrostatic pressure decreases, sea water 15 within chambers 259*b* is exhausted through vent line 256, and fluid within tank 220 is allowed to expand and move through outlet 223, header 254, and inlets 252 into chambers 259*a*, thereby decreasing the fluid pressure within tank 220. In this example, tank 220 is filled with sea water 15, liquid hydrocarbons 16, and drilling fluids 17, and outlet 223 is in fluid communication with sea water 15 within tank 220. Thus, sea water 15 flows from tank 220 into chambers 259*a*. However, in general, any fluid within tank 220 in fluid communication with outlet 223 (e.g., sea water, liquid hydrocarbons, drilling fluids, etc.) may flow into chambers 259*a* to relieve pressure within tank 220 during recovery to the surface.

Figure 20:
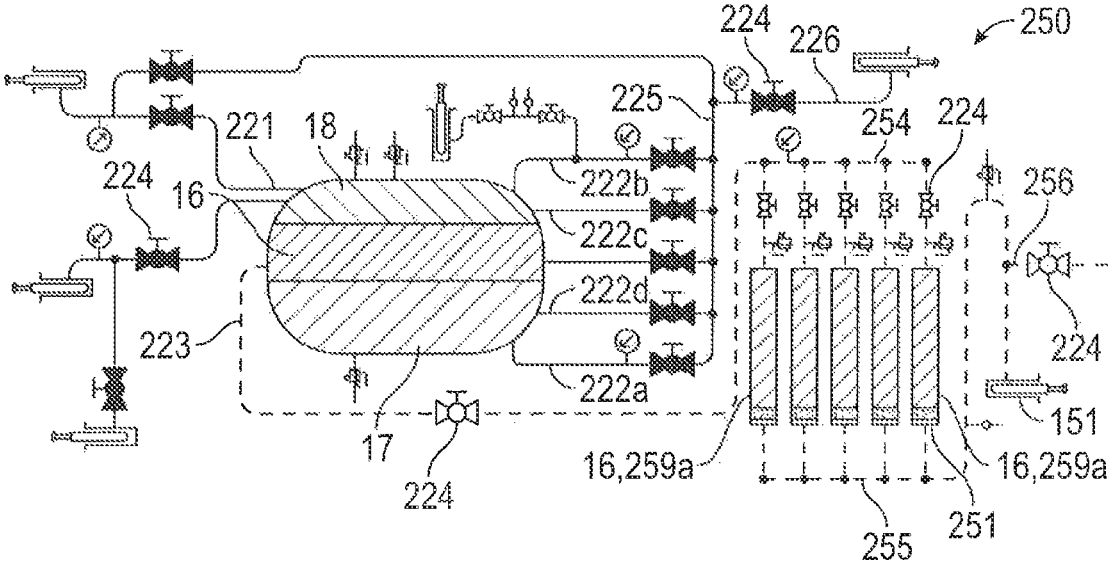
FIG. 20 is a schematic view of the storage tank and compensation system of FIG. 14 filled with liquid hydrocarbons, drilling fluids, and gas during recovery to the surface.

As previously described, at depth, any gas in the captured fluids will likely be dissolved in solution. However, when tank assemblies 210 are recovered to the surface and fluids within tanks 220 is allowed to expand into chambers 259*a*, the dissolved gas may come out of solution and expand. Without being limited by this or any particular theory, the expansion of gas coming out of solution is typically significantly greater than expansion of the associated liquid itself. However, compensation systems 250 provides sufficient added volume to accommodate for the expansion of gases coming out of solution. For example, FIG. 20 illustrates an exemplary tank 220 being recovered to the surface. Open valves 224 are shown in white with a black outline, while closed valves 224 are colored completely black. As the hydrostatic pressure decreases, sea water 15 within chambers 259*b* is exhausted through vent line 256, and fluid within tank 220 is allowed to expand and move through outlet 223, header 254, and inlets 252 into chambers 259*a*, thereby decreasing the fluid pressure within tank 220. In this example, tank 220 is filled with liquid hydrocarbons 16 and drilling fluids 17, and outlet 223 is in fluid communication with liquid hydrocarbons 16 within tank 220. Thus, liquid hydrocarbons 16 flow from tank 220 into chambers 259*a*. As the pressure within tank 220 decreases, due to the expansion of liquid hydrocarbons 16 and drilling fluids 17, gas 18 dissolved in hydrocarbons 16 and/or drilling fluids 17 at the sea floor come out of solution and expand within tank 220. However, as gases 18 expand, fluid within tank 220 in fluid communication with outlet 223 (e.g., liquid hydrocarbons 16, drilling fluids 17, gas 18) may flow into chambers 259*a* to relieve pressure within tank 220 during recovery to the surface.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A subsea containment system for capturing fluids leaking from a subsea well having an upper end including a primary conductor extending into the sea bed, an outer wellhead housing coupled to the primary conductor, and an inner wellhead housing mounted to the outer wellhead housing, the system comprising:

a clamping assembly including an annular clamp body configured to be disposed about the upper end of the well and a fluid outlet extending from the clamp body, wherein the fluid outlet is in fluid communication with an inner cavity of the clamp body;

wherein the clamp body has a central axis, an upper end, and a lower end, and wherein the clamp body includes:

a first through passage extending axially through the upper end to the inner cavity;

a second through passage extending axially through the lower end to the inner cavity;

an upper annular seal assembly radially positioned between the upper end of the clamp body and the first through passage; and a lower annular seal assembly radially positioned between the lower end of the clamp body and the second through passage;

wherein the upper annular seal assembly is configured to sealingly engage the inner wellhead housing;

wherein the lower annular seal assembly is configured to sealingly engage the primary conductor; and wherein the inner cavity is sized to receive the outer wellhead housing with the clamp body disposed about the outer wellhead housing; and a storage system coupled to the fluid outlet of the clamping assembly, wherein the storage system includes a first storage tank having an inlet in fluid communication with the inner cavity of the clamp body and a plurality of vertically spaced outlets.

2. The subsea containment system of claim 1, wherein the storage system includes a second storage tank having an inlet in fluid communication with one of the outlets of the first storage tank and a plurality of vertically spaced outlets; and wherein the first storage tank and the second storage tank are configured to be disposed at the sea floor.

3. The subsea containment system of claim 2, wherein the plurality of outlets of the first storage tank are connected to a first outlet header and the plurality of outlets of the second storage tank are connected to a second outlet header.

4. The subsea containment system of claim 2, wherein the first storage tank has an expanded fluid outlet coupled to a first compensation system configured to receive expanding fluids from the first storage tank during retrieval to the surface from the sea floor, and wherein the second storage tank has an expanded fluid outlet coupled to a second compensation system configured to receive expanded fluids from the second storage tank during retrieval to the surface from the sea floor.

5. The subsea containment system of claim 4, wherein each compensation system includes a plurality of piston-cylinder assemblies, each piston cylinder assembly including a piston moveably disposed within a cylinder;

wherein each piston divides the corresponding cylinder into a first chamber and a second chamber;

wherein the each cylinder has an inlet coupled to the expanded fluid outlet of the corresponding storage tank and in fluid communication with the corresponding first chamber.

6. The subsea containment system of claim 1, wherein the clamp body is a split body formed from a first clamp portion releasably attached to a second clamp portion.

7. The subsea containment system of claim 1, wherein the clamping assembly includes an ROV panel attached to the first body portion, wherein the ROV panel includes a first receptacle configured to supply hydraulic pressure to the upper seal assembly and the lower seal assembly.

8. The subsea containment system of claim 7, wherein the ROV panel includes a second receptacle configured to supply a sealant to the upper seal assembly and a third receptacle configured to supply a sealant to the lower seal assembly.

9. The subsea containment system of claim 7, wherein the ROV panel includes a second receptacle configured to supply methanol to the inner cavity of the clamp body.

10. The subsea containment system of claim 1, wherein the first storage tank is configured to hold a plurality of fluids, each fluid having a different density;

wherein each of the plurality of vertically spaced outlets is configured to flow one of the plurality of fluids.

11. The subsea containment system of claim 1, wherein the inner cavity is configured to receive fluids flowing from a cement port extending radially through the outer wellhead housing.

12. The subsea containment system of claim 1, wherein the lower annular seal assembly includes a seal element that is configured to be selectively energized to engage the primary conductor.

13. The subsea containment system of claim 1, wherein the upper annular seal assembly is configured to form a static seal between the upper annular seal assembly and the inner wellhead housing; and wherein the lower annular seal assembly is configured to form a static seal between the lower annular seal assembly and the primary conductor.

14. A system comprising:

a subsea well having an upper end comprising:

a primary conductor extending into the sea bed;

an outer wellhead housing coupled to the primary conductor; and an inner wellhead house mounted to the outer wellhead housing;

a clamping assembly including an annular clamp body configured to be disposed about the upper end of the subsea well and a fluid outlet extending from the clamp body, wherein the fluid outlet is in fluid communication with an inner cavity of the clamp body;

wherein the clamp body has a central axis, an upper end, and a lower end, and wherein the clamp body includes:

a first through passage extending axially through the upper end to the inner cavity;

a second through passage extending axially through the lower end to the inner cavity;

an upper annular seal assembly disposed within the first through passage; and a lower annular seal assembly disposed within the second through passage;

wherein the upper annular seal assembly directly sealingly engages the inner wellhead housing such that a static seal is formed between the upper annular seal assembly and the inner wellhead housing;

wherein the lower annular seal assembly directly sealingly engages the primary conductor such that a static seal is formed between the lower annular seal assembly and the primary conductor; and wherein the inner cavity surrounds and receives the outer wellhead housing between the upper annular seal assembly and the lower annular seal assembly; and a storage system coupled to the fluid outlet of the clamping assembly, wherein the storage system includes a plurality of storage tanks disposed at the sea floor and coupled to one another in series, wherein a first of the storage tanks has an inlet in fluid communication with the inner cavity of the clamp body; and wherein each storage tank has a plurality of vertically spaced outlets, wherein each outlet is positioned and configured to communicate a fluid having a different density from the corresponding storage tank.

15. The system of claim 14, wherein each storage tank of the storage system includes a corresponding compensation system coupled thereto and configured to receive expanding fluids from the corresponding storage tank during retrieval to the surface from the sea floor; wherein each compensation system includes:

a plurality of piston-cylinder assemblies, each piston-cylinder assembly including a piston movably disposed within a cylinder;

wherein each piston divides the corresponding cylinder into a first chamber and a second chamber; and wherein the first chamber of each piston-cylinder assembly is configured to be placed in fluid communication with the corresponding storage tank and the second chamber of each piston cylinder assembly is configured to be placed in fluid communication with an ocean environment surrounding the corresponding storage tank.

* * * * *